US006899417B1

(12) United States Patent
Shinada et al.

(10) Patent No.: US 6,899,417 B1
(45) Date of Patent: May 31, 2005

(54) INK CARTRIDGE FOR USE IN AN INK JET RECORDING APPARATUS

(75) Inventors: Satoshi Shinada, Nagano-ken (JP); Minoru Usui, Nagano-ken (JP); Takahiro Naka, Nagano-ken (JP); Hisashi Koike, Nagano-ken (JP); Tomio Yokoyama, Nagano-ken (JP); Yasuhiko Kamijo, Nagano-ken (JP); Koichi Toba, Nagano-ken (JP); Takeo Seino, Nagano-ken (JP); Yasuhiro Ogura, Nagano-ken (JP); Takayuki Aizawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 455 days.

(21) Appl. No.: 09/698,143

(22) Filed: Oct. 30, 2000

(30) Foreign Application Priority Data

| | | |
|---|---|---|
| Oct. 29, 1999 | (JP) | 11-308762 |
| Nov. 15, 1999 | (JP) | 11-323713 |
| Apr. 4, 2000 | (JP) | 2000-101676 |
| Apr. 28, 2000 | (JP) | 2000-129704 |

(51) Int. Cl.[7] ..... B41J 2/175
(52) U.S. Cl. ..... 347/86
(58) Field of Search ..... 347/19, 50, 85–87, 347/7, 49; 222/56, 187

(56) References Cited

U.S. PATENT DOCUMENTS

| | | | | | |
|---|---|---|---|---|---|
| 5,631,682 | A | * | 5/1997 | Takata | 347/86 |
| 5,633,667 | A | * | 5/1997 | Miyazawa | 347/86 |
| 5,790,158 | A | * | 8/1998 | Shinada et al. | 347/86 |
| 6,102,533 | A | * | 8/2000 | Nozawa et al. | 347/86 |
| 6,130,695 | A | * | 10/2000 | Childers et al. | 347/85 |
| 6,161,927 | A | * | 12/2000 | Long et al. | 347/86 |
| 6,250,750 | B1 | * | 6/2001 | Miyazawa et al. | 347/87 |
| 6,270,207 | B1 | * | 8/2001 | Sasaki | 347/86 |
| 6,302,527 | B1 | * | 10/2001 | Walker | 347/50 |
| 6,302,530 | B1 | | 10/2001 | Shimada et al. | |
| 6,336,719 | B1 | * | 1/2002 | Ishinaga et al. | 347/86 |
| 6,361,138 | B1 | * | 3/2002 | Seino et al. | 347/19 |
| 6,416,152 | B1 | * | 7/2002 | Matsuzaki et al. | 347/19 |
| 6,502,917 | B1 | * | 1/2003 | Shinada et al. | 347/19 |

FOREIGN PATENT DOCUMENTS

| | | | | |
|---|---|---|---|---|
| EP | 0703083 | A2 | 3/1996 | |
| EP | 0941856 | A2 | 9/1999 | |
| EP | 0 963 847 | A1 | 12/1999 | |
| GB | 2315461 | A | 2/1998 | |
| JP | 08-132636 | A | 5/1996 | |
| JP | 9-262988 | | 10/1997 | B41J/2/175 |
| JP | 09-277549 | A | 10/1997 | |
| JP | 10-166606 | A | 6/1998 | |
| JP | 10-175309 | A | 6/1998 | |
| JP | 10-296995 | A | 11/1998 | |
| JP | 11-291518 | A | 10/1999 | |
| WO | 99/59823 | * | 11/1999 | |

OTHER PUBLICATIONS

Notice of Rejection dated Jun. 23, 2004 for JP 11–308762.
European Search Report dated Jan. 31, 2002.

* cited by examiner

*Primary Examiner*—Michael Nghiem
(74) *Attorney, Agent, or Firm*—Sughrue Mion, PLLC

(57) ABSTRACT

An ink cartridge containing a container body 3 housing an ink absorbing member 6' so as to absorb ink, a lid member 4, and a spacer 30 pressing the ink absorbing member 6' between the lid member 4 and ink absorbing member 6'. It is possible to decrease the volume of the ink absorbing member 6' without changing structure in the vicinity of an ink supply port by using the same shape of a container body 3 and a lid member 4.

28 Claims, 31 Drawing Sheets

INK CARTRIDGE FOR USE IN AN INK JET RECORDING APPARATUS

BACKGROUND OF THE INVENTION

1. Field of the Art

The present invention relates to an ink cartridge for supplying ink to a recording head. The ink cartridge is mounted on a carriage in which a recording head for jetting ink droplets is attached.

2. Related Art

An ink jet recording apparatus prints images of photo-like quality with a relatively simple structure, so that it is widely used as a recording apparatus for personal use. In such a recording apparatus, recording heads for a black ink and color inks are generally mounted on a carriage, then cartridges for the black ink and the color inks are installed thereon, thereby the inks are supplied to each recording head via an ink supply needle.

In the case that most of the printing to be printed by the recording apparatus is composed of text data, the amount of the color inks to be used is little and the color inks are not frequently used, so that the frequency of an exchange of the color ink cartridge is much lower than that of the black ink cartridge. Accordingly, there is a problem that the effective date of the color ink cartridge expires before the consumption of all of the color inks, which requires the premature replacement of the color ink cartridge, thereby increasing the cost.

On the other hand, when a color printing is often conducted the black ink is not frequently used and the effective date may expire before consuming all of the ink in the black cartridge.

Moreover, when the recording apparatus itself is not used frequently, the effective date expires when the inks remain in both black and color ink cartridges.

In order to solve the above-mentioned problem, an ink cartridge may be produced by decreasing the volume of the ink cartridge. However, a gap is generated between the ink cartridge and a holder housing the ink cartridge, so that a distortion may be generated by the reciprocating carriage at a connecting portion between the ink supply needle and an ink supply port. Also, a new metallic mold is necessary, thereby increasing costs.

In order to solve those problems, as shown in Japanese published application no. 9-262988, a filler is inserted in the bottom of a container body composing an ink cartridge with a normal volume so as to decrease the amount of filled ink.

According to the reference, just filling the filler in the container body makes the amount of the filled ink decrease without changing a shape of the container. However, a shape adjacent to an ink supply port is changed, which greatly affects the outflow characteristics of ink to the recording head. Therefore, the printing characteristics may be fluctuated.

It is an object of the present invention to provide an ink cartridge with a small volume, which has the same characteristics of ink discharge as those of an ink cartridge with a normal volume.

It is another object of the present invention to provide a small volume ink cartridge by using the same container body of an ink cartridge with a normal volume.

It is another object of the present invention to provide an ink cartridge for use in an ink jet recording apparatus for minimizing the amount of stored ink without causing any difficulties attaching to and removing from a carriage.

It is another object of the present invention to provide an ink cartridge for use in an ink jet recording apparatus without wasting material, or without using any spacer and so on.

SUMMARY OF THE INVENTION

In the first embodiment of the present invention, an ink cartridge comprises a container body and a lid member. The container body comprises an ink chamber housing, an ink absorbing member for absorbing ink, and an ink supply port supplying the absorbed ink to an ink recording head. The lid member seals an opening portion of the container body, and a spacer is inserted between the lid member and the ink absorbing member so as to compress the ink absorbing member toward the ink supply port. Therefore, it is possible to use the same container body and the same lid member of the ink cartridge with a normal volume. It is also possible to decrease the volume of the ink absorbing member without changing the structure adjacent to the ink supply port and without affecting the relationship between the ink absorbing member and the ink supply port, such as the compressed condition of the ink absorbing member.

In the second embodiment of the present invention, an ink cartridge comprises a container body installed in a holder of a carriage. The container body comprises an ink chamber communicating with a recording head provided in the carriage via an ink supply needle and an ink supply port. Internal space of the container body is divided into a plurality of areas by walls, and ink is stored at least in one area in which ink supply ports are provided. Therefore, it is possible to decrease the volume of ink stored area in the same container body of an ink cartridge with a normal volume without causing inconveniences by carriage movement. It is also possible to produce a small volume ink cartridge suitable for small amount of printing.

In the third embodiment of the present invention, an ink cartridge comprises a container body, which is a substantially rectangular parallelepiped and installed in a holder of a carriage. The container body comprises an ink chamber communicating with a recording head provided with a carriage via an ink supply needle of the recording head and an ink supply port. An ink supply port is provided with one short side wall. At the other short side wall, a concave portion protruding to the ink chamber is formed. At the concave portion, a rib is formed so as to be in parallel with a long side wall and protrude to the ink supply port. An absorbing member comprising an elastic ink absorbing member, according to the length of the ink chamber, is supported by one of the side walls and the rib. Therefore, at the ink supply port, the ink absorbing member is compressed as well as that of an ink cartridge with a normal volume having no rib, and the same characteristics of ink supply are maintained. It is also possible to produce an ink cartridge with less ink volume by slightly redesigning a metallic mold for a container body used for an ink cartridge with a normal volumes. Moreover, the outer shape of the ink cartridge with a small volume is the same as that with a normal volume, so that changing a manufacturing line is not necessary, and manufacturing costs are decreased.

In the fourth embodiment, the bottom portion of a long side wall of a container body is narrowed by a side wall protruding to the central area via a slope. Therefore, an are a to be easily gripped for attaching to or removing from is not unnecessarily small. It is possible to insert an ink absorbing member into a container body by just squeezing.

EXPLANATION OF PREFERRED EMBODIMENTS

Figure 1:
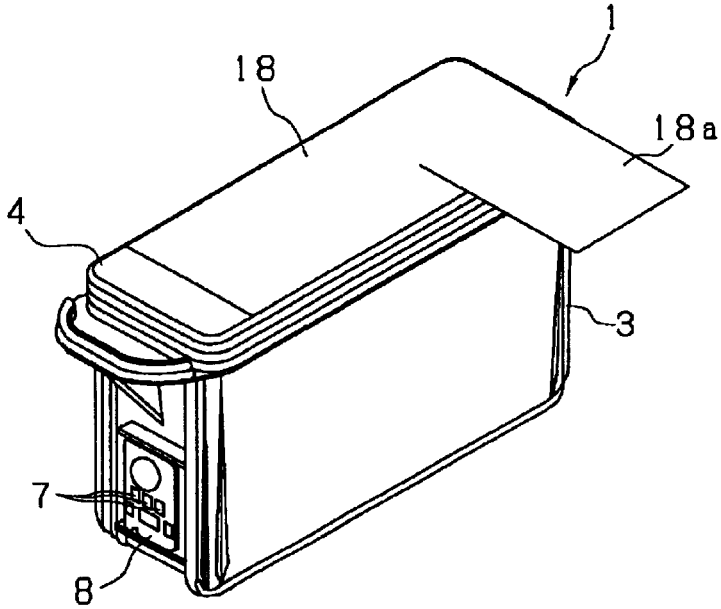
FIG. 1 shows the first embodiment of an ink cartridge of the present invention.

FIG. 1 is an example showing a black ink cartridge with a normal volume, which is to be minimized in the present invention. An ink cartridge 1 comprises a container body 3 made from high polymer and a lid member 4. The container body 3 comprises an ink chamber 2 so as to obtain an approximate rectangular parallelepiped space. The lid member 4 seals an opening portion of the container body 3. At one side of the container body 3, or at a lower surface 3*b* in this embodiment, an ink supply port 5 is formed so as to engage with an ink supply needle 22 and to communicate with a recording head 20. In the container body 3, an elastic and substantially rectangular parallelepiped ink absorbing member 6 is inserted so as to retain ink by absorption. (This specification includes a rectangular parallelepiped shape whose upper surface slightly opens.)

At a surface adjacent to where the ink supply port 5 is formed, a circuit board 8 is fixed. Electrodes 7 for connecting outside are formed on the surface of the circuit board and a storage device for storing specific information is provided on the back of the circuit board so as to identify an ink cartridge 1 such as manufacture serial no., the date of manufacture, the amount of ink, and the like. [see FIGS. 34(*a*) and (*b*)]

On the back of a lid member 4, ribs 9 are formed so as to obtain space between the ink absorbing member 6 and the lid member 4. In the lid member 4, an ink injecting port 10 for injecting ink to the ink absorbing member 6 and an air communicating port 11 for communicating with the space are provided. On the surface of the lid member 4, a narrow groove 12 is formed so as to form one edge which extends to the air communicating port 11 and another edge which extends to another area. Another area means an area which is opposed to a removable part 18*a* and a place which is the furthest from the ink supply port.

Figure 2:
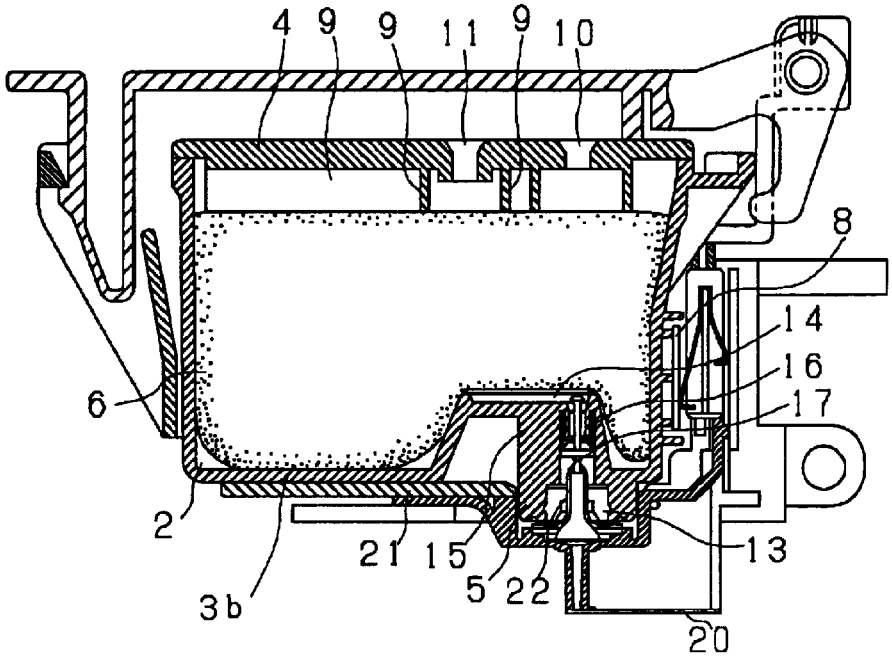
FIG. 2 shows a cross sectional structure view in condition that the ink cartridge is mounted on a recording apparatus.

FIG. 2 shows the internal structure of the in cartridge 1 When the ink cartridge 1 is mounted on a carriage 21 fixing a recording head 20 at a predetermined position, the ink supply port 5 communicates with the recording head 20 via the ink supply needle 22. The ink supply port 5 is easily attached to or removed from the ink supply needle 22. When the ink supply needle 22 is inserted into the ink supply port 5. the ink supply needle 22 is assured to be sealed with a packing 13.

Above the packing 13, a convex portion 15 having an ink flow path 14 is formed at the side of the ink chamber 2. In a cavity of the convex portion 15 there is a valve. The valve comprises a valve body, a packing, and a spring. The valve body 17 constantly presses the packing 13 by a spring 16 so as to open when the ink supply needle 22 is inserted into a predetermined position. When the ink supply needle 22 is not inserted, the valve is formed to prevent ink leakage by which the valve body 17 presses the surface of the packing 13.

Figure 3:
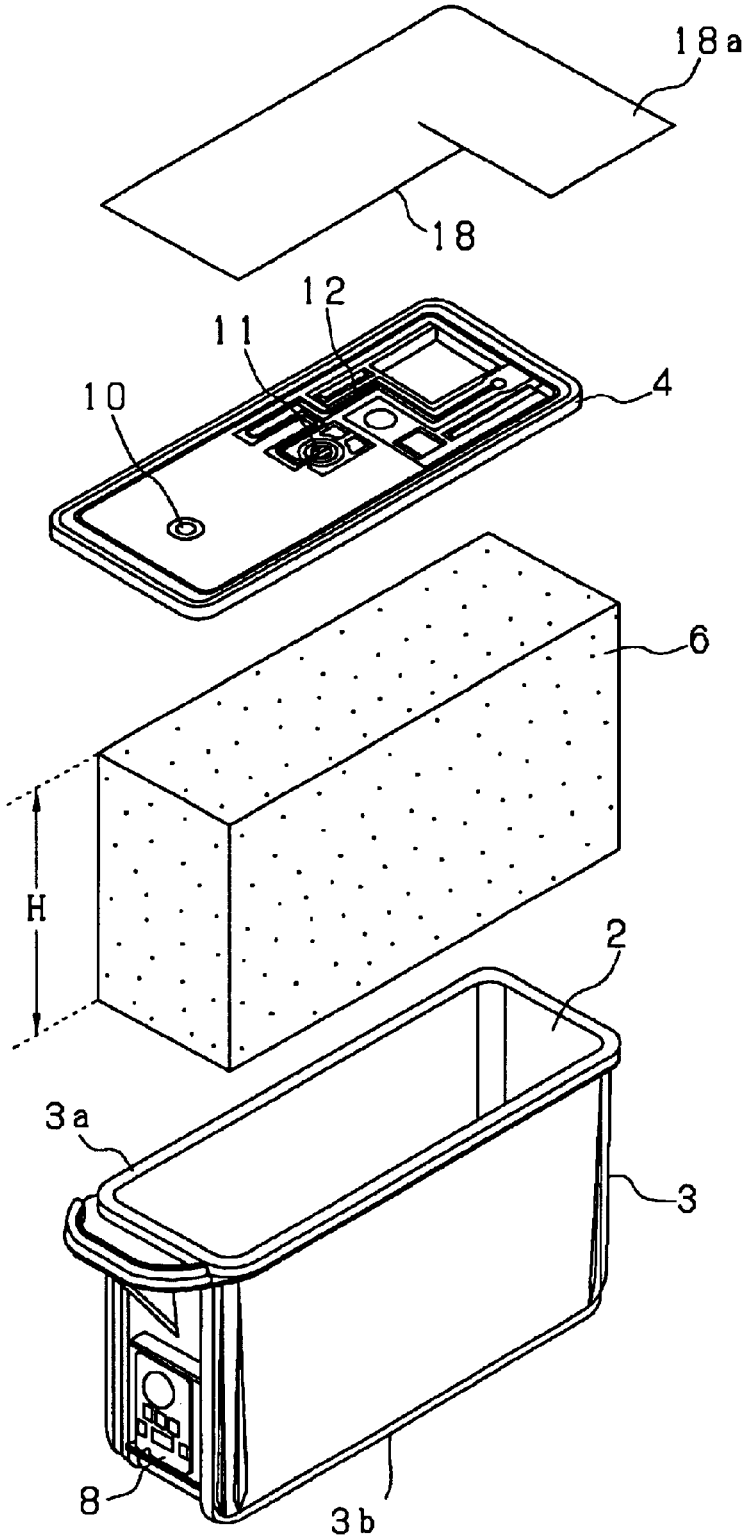
FIG. 3 is a perspective assembly view showing the ink cartridge.

In such a constructed ink cartridge 1, the rectangular parallelepiped ink absorbing member 6 is inserted into the ink chamber 2 of the container body 3 as shown in FIG. 3, and an opening portion of the container body 3 is joined the lid member 4 with fuse bonding so as to seal. On an exposed surface of the ink supply port 5, a film (not-shown) is attached so as to be torn by inserting the ink supply needle 22.

In such sealed condition, when the pressure inside of the container body is reduced by connecting an discharging pipe with an air communicating port 11 of the lid member 4 and inserting an ink injecting needle into the ink absorbing member 6 from an ink injecting port 10, air in a flow path of the ink supply port 5 and in internal space of the ink absorbing member 6 is removed.

When reduced pressure is continued and ink is injected via the ink injecting needle, the ink is effectively absorbed in the internal space of the ink absorbing member 6. After completion of the ink filling, the ink cartridge is housed in a reduced pressure chamber and reduced pressured is continued further. Then a film for sealing 18 which has the removable part 18*a* is attached to the lid member 4 to complete the ink cartridge 1.

Figure 4:
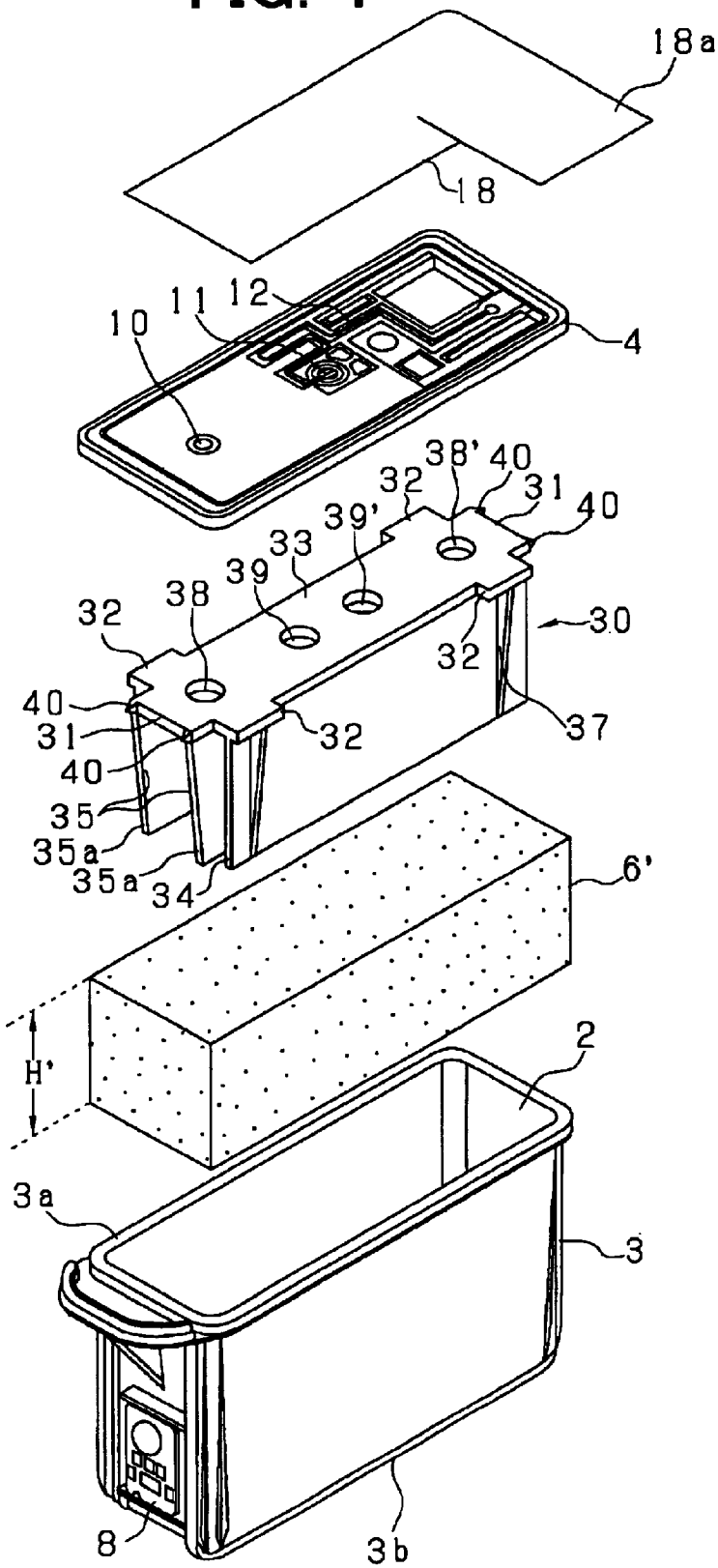
FIG. 4 is a perspective view showing assembly embodiment in the case that a container body of the ink cartridge with a normal volume is used.
Figure 5:
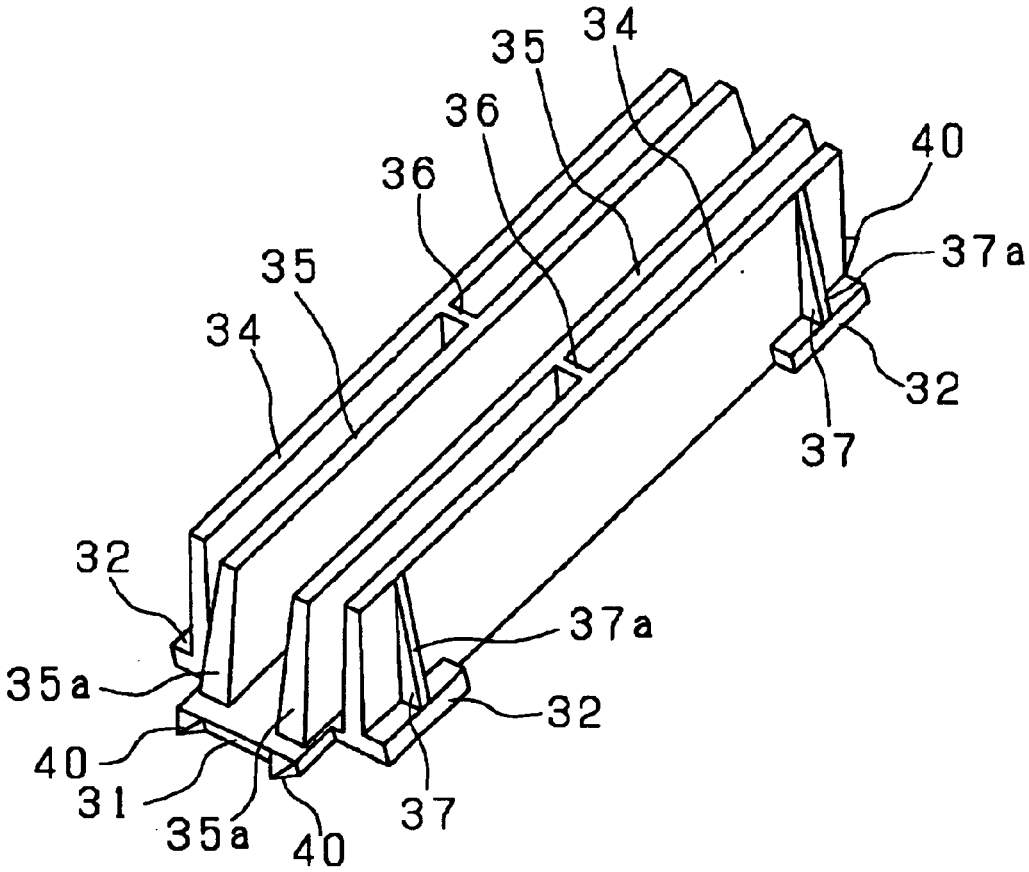
FIG. 5 is a perspective view showing one embodiment of a spacer inserted into the ink cartridge with a side of the ink absorbing member up.

On the other hand, when producing an ink cartridge with a small volume, a second ink absorbing member 6' is inserted into the ink cartridge. The ink absorbing member 6' substantially has the same cross sectional shape as the ink absorbing member 6 as shown in FIG. 4. However, the height H' of the ink absorbing member 6, according to the ink amount, is smaller than the height H of the ink absorbing member of an ink cartridge with normal cartridge. A spacer 30 is composed of a base 33 having protrusions 31 at both edges in longitudinal direction and protrusions 32 at edges adjacent the both edges as shown in FIG. 5. The spacer 30 further comprises ribs 34 and 35 which are substantially perpendicular to the base 33 and extend to the longitudinal direction of the base 33.

These ribs 34 and 35 are formed in two rows at both sides so as to be positioned inside of the base 33. Both edges of the ribs 35 positioned at a side of centerline protrude further in the longitudinal direction than the ribs 34 positioned at outside. And, the ribs 35 are positioned inside of the protrusions 31 of the base 33. Both side surfaces 35*a* are formed to be a slope so as to make the base 33 face outside. The ribs 34 and 35 are joined by ribs 36, which are perpendicular to the ribs 34 and 35. The protrusions 32 at both sides and the ribs 34 are joined by ribs 37 having slopes 37*a*. The ribs 36 properly maintain a gap between the ribs 34 and 35, namely a large gap is maintained so as to prevent ink from being absorbed between the ribs 34 and 35 by capillary action and to prevent entered ink from being stagnant due to its meniscus so as to give the spacer 30 rigidity for maintaining the whole shape of the spacer 30.

In the base 33, through holes 38, 39, 38' and 39' are provided so as to be opposed to where at least the ink injecting port 10 or the air communicating port 11 is formed in the lid member 4. The through holes are set to be symmetric with respect to each other. At both edges of the protrusions 31, 31 in the longitudinal direction, projections 40 are formed. The projections 40 strongly contact with the inside of the container body 3 by friction force and functions for keeping the ink absorbing member 6 compressed until the container body 3 and the lid member 4 are adhered.

After inserting the ink absorbing member 6' into the container body 3, such a constructed spacer 30 is inserted into the container body 3 with the ribs 34 and 35 face down. Then the lid member 4 is pressed after covering the lid member 4 on the opening portion 3*a* of the container body 3. And, the ink absorbing member 6' moves toward the bottom of the container body 3 as if the ink absorbing member 6' was compressed by the lid member 4 via the spacer 30.

In the spacer 30, the through holes 38 and 39, and 38' and 39' are formed so as to be symmetric with respect to each other. Therefore, even if the spacer 30 is inserted with the left and right side opposite, either the through holes 38 or 38' corresponds to the ink injecting port 9, so that further ink filling is not prevented. The ribs 34 and 35 are set at both sides so as to be positioned in the vicinity of the internal wall of the container body 3. Therefore, it is possible to squeeze the ink absorbing member 6' whose surface easily swells toward the bottom of the container body 3 by friction generated between the ribs 34, 35 and the internal wall. The spacer 30 does not prevent the insertion of the ink injecting needle.

Figure 6A:
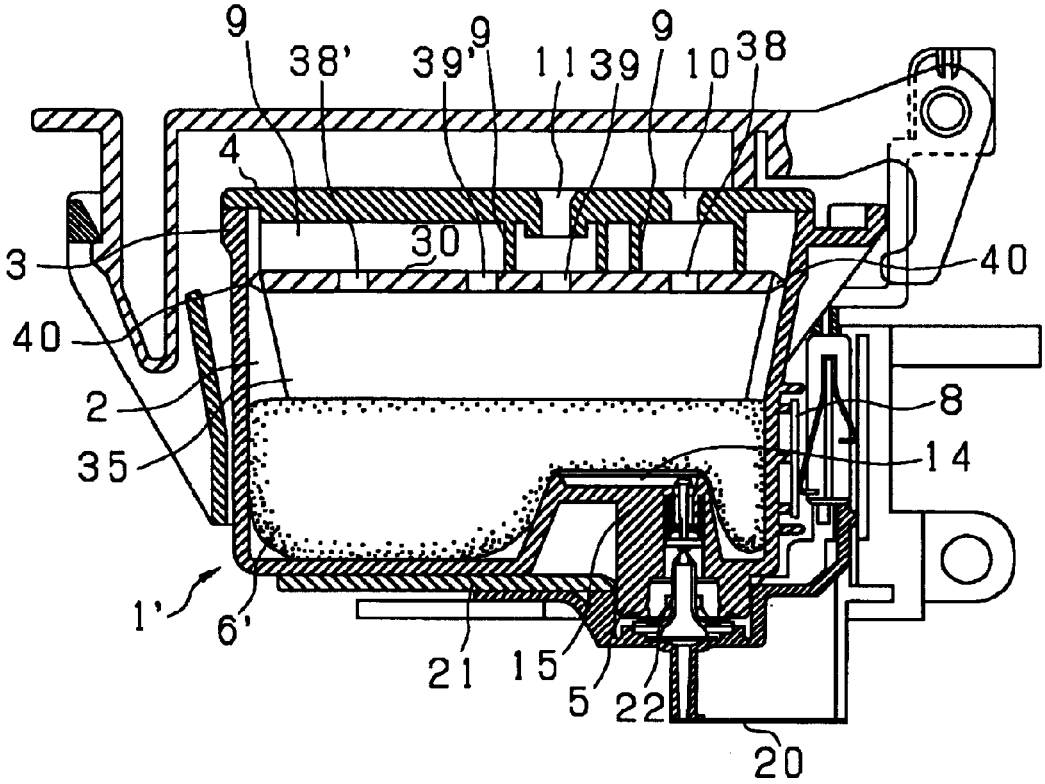
FIGS. 6(*a*) and (*b*) are cross sectional views showing one embodiment of an ink cartridge with a small volume mounted on a recording apparatus.
Figure 6B:
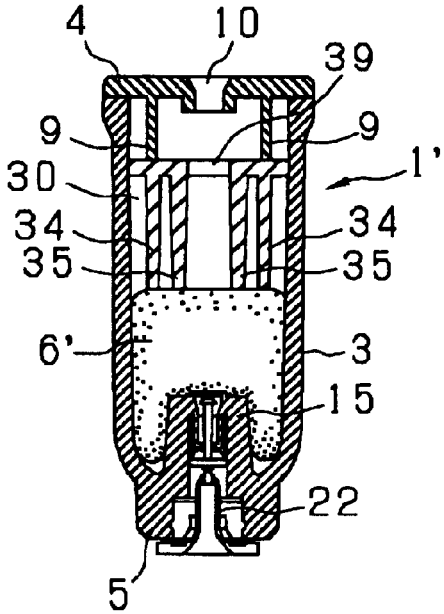

After the spacer 30 and the ink absorbing member 6' are set, both projections 40 of the protrusions 31 and 31 strongly contact with the internal wall of the container body 3 as shown in FIG. 6(*a*) so as to prevent the rise of the ink absorbing member 6. Under this condition, the opening portion 3*a* of the container body 3 is sealed with the lid member 4 by fuse bonding. An exposed surface of the ink supply port 5 is sealed with a film, so that the container body is completed. The film is penetrated by the ink supply needle 22.

In addition, the air communicating port 11 is connected with the discharging pipe, and the ink injecting needle is inserted into the ink absorbing member 6' from the ink injection port 10. Passing through between the through holes 38 of the spacer 30 and ribs 35 and reaching the ink absorbing member 6', the leading edge of the ink injecting needle is inserted into the ink absorbing member 6'. Under this condition, the interior of the container body is reduced pressure by the discharging pipe, and air in the ink supply port 5 and in the internal space of the ink absorbing member 6' is removed.

After that, when ink which is absorbable volume in the ink absorbing member is filled with the second ink absorbing member 6' by the ink injecting needle, the ink is absorbed in internal space of the ink absorbing member 6'. When ink filling is completed, reduced pressure is further conducted by housing the ink cartridge in a pressure reduced chamber. After that, a film for sealing 18 having the removable part 18*a* is attached to the lid member 4. Then, the ink cartridge with a small volume is completed.

A storage device provided on a circuit board 8 stores data which identifies the ink cartridge as well as the decreased amount of ink.

In such an ink cartridge 1' with a small volume, since the ink absorbing members 6' is compressed by the ribs 34 and 35 from above, the ink absorbing member 6' receives the appropriate pressure according to a shape of the convex portion 15. The ribs 35 are positioned outside of the convex portion 15. Accordingly, flow resistance of the ink supply port 5 in the ink flow path is not increased unnecessarily.

When the ink cartridge 1' is mounted on a recording apparatus as shown in FIG. 6(*a*), the ink supply needle 22 connects with the ink chamber 2 via the ink supply port 5 with fluid tightness. In the vicinity of the ink supply port 5, the ink absorbing member 6' around the convex portion 15 is compressed by the spacer 30 in the same manner at the ink cartridge with a normal volume. Accordingly, the ink is assured to be supplied to the recording head 20 independent of the amount of ink filled.

Figure 7A:
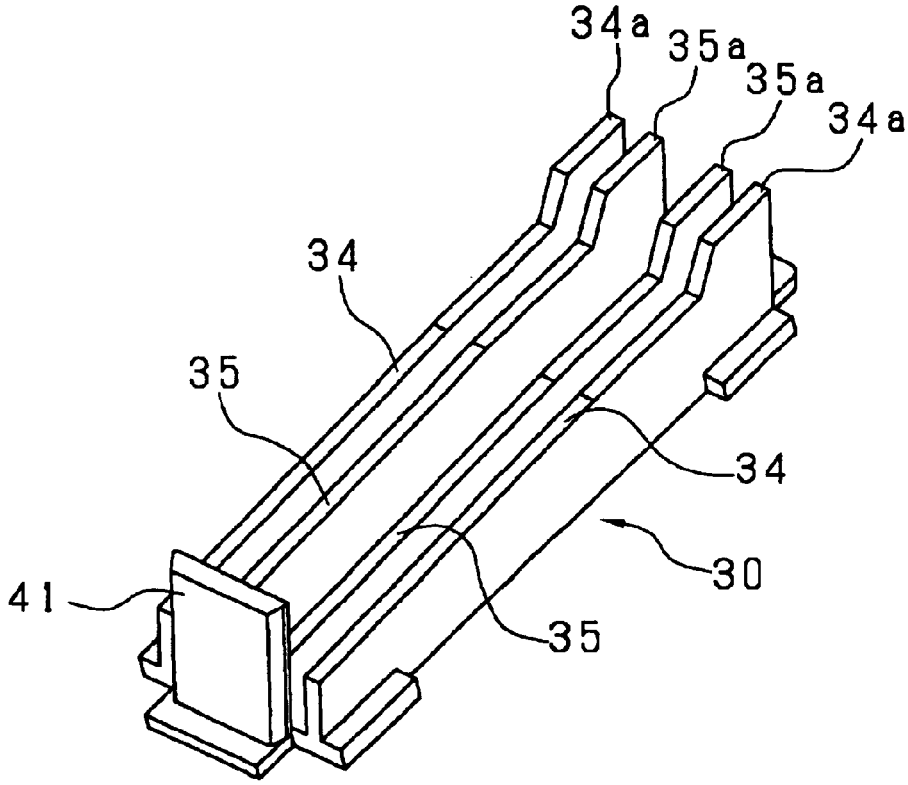
FIGS. 7(*a*) and (*b*) are a perspective view seen from an ink absorbing member, and a cross sectional view showing another embodiment of a spacer inserted into an ink cartridge, respectively.
Figure 7B:
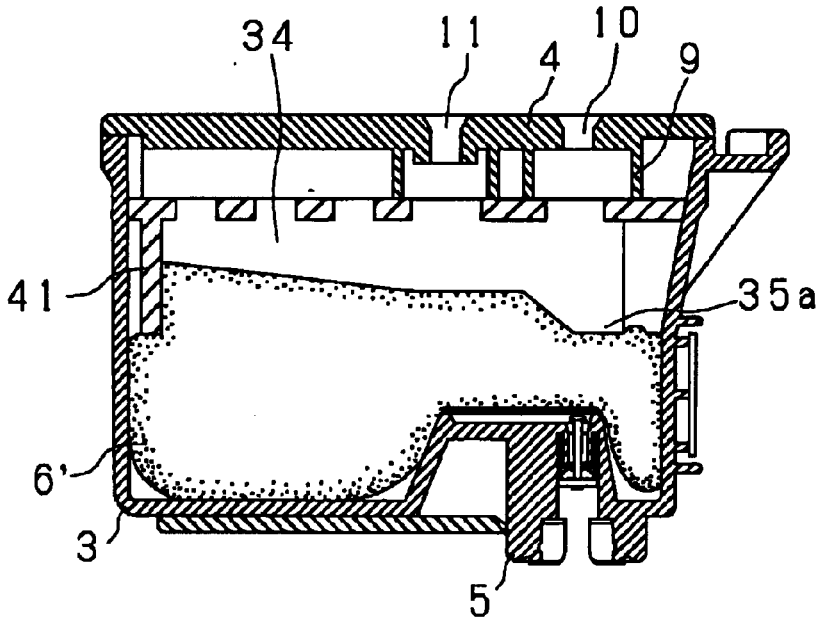

In the above-mentioned embodiment, the spacer 30 is formed to be symmetric. However, as shown in FIG. 7(*a*), when convex portions 34*a* and 35*a* of the ribs 34 and 35 are formed to be opposed to the ink supply port 5, the vicinity of the ink supply port 5 is selectively compressed as shown in FIG. 7(*b*), so that the ink is ensured to discharge from the ink supply port 5.

In addition, when a perpendicular wall 41 is formed at the edge portion of the spacer apart from the ink supply port 5, the furthest area of the ink absorbing member away from the ink supply port 5, namely the upper edge area is pressed toward the ink supply port 5, so that the ink in the absorbing member 6' is further ensured to lead to the ink supply port 5.

Figure 8A:
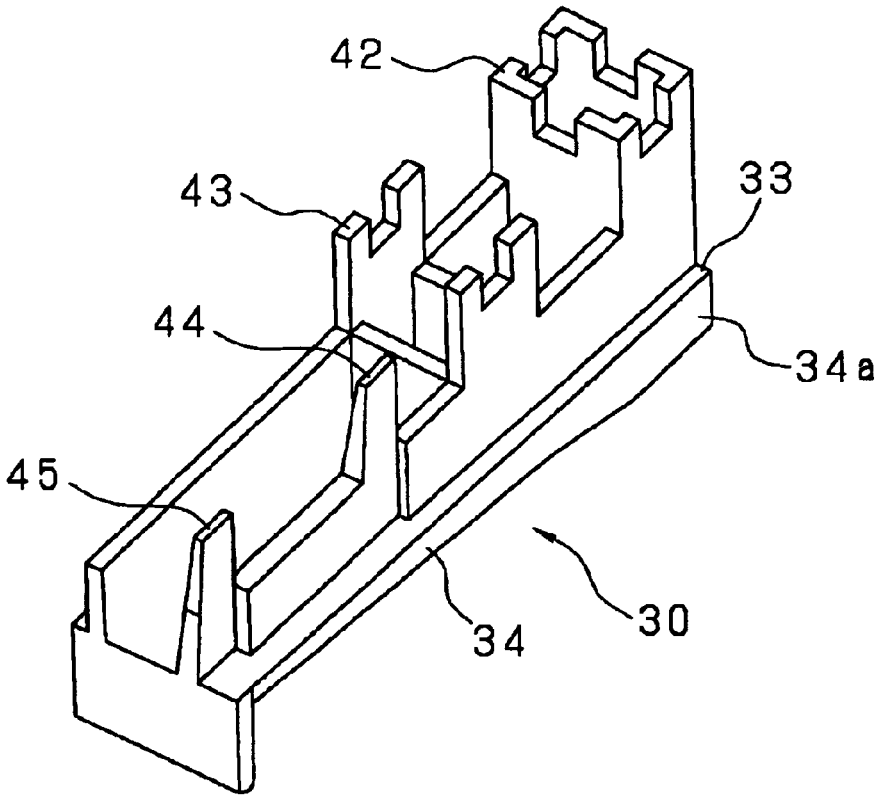
FIGS. 8(*a*) and (*b*) are a perspective view of the spacer inserted into an ink cartridge seen from a lid member, and a cross sectional view of an ink cartridge in which the spacer is inserted, respectively.
Figure 8B:
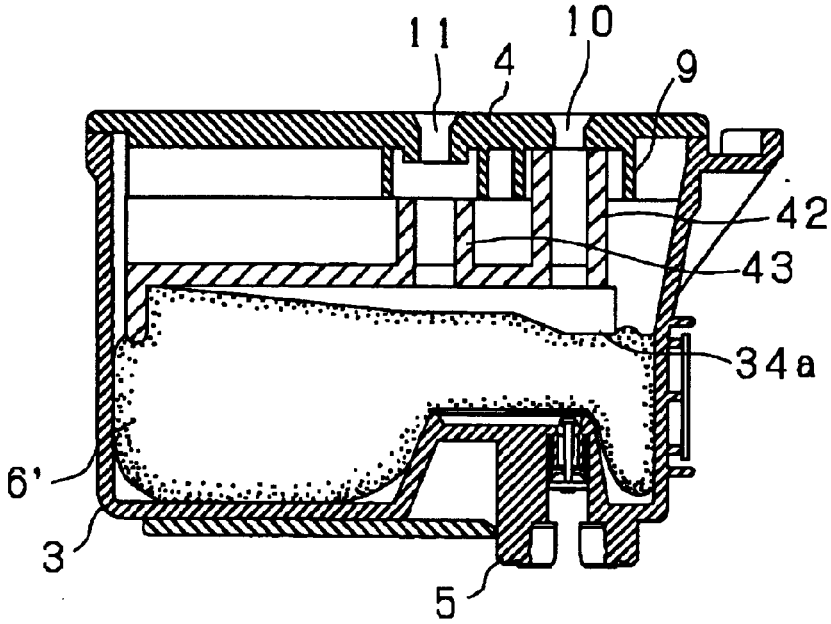

In the above mentioned embodiment, ribs 9 of the lid member 4 contact with the base 33. However, as shown in FIG. 8(*a*), when wall-shape projections 42, 43 are formed on the base 33 so as to engage with the ribs 9 surrounding the ink injecting port 10 and the air communicating port 11, and projections 44, 45 engaging between the ribs 9 of the lid member 4 are formed, the spacer 30 is constantly pressed against the ink absorbing member 6' despite of the convex portions 34*a* and 35*a* of the ribs 34 and 35.

In the above-mentioned embodiment, the inks supply port 5 is sealed with the valve body 17 which is opened by the ink supply needle and the packing member as an example. However, providing only a packing engaging with an ink supply needle with air tight brings the same effect.

Figure 9:
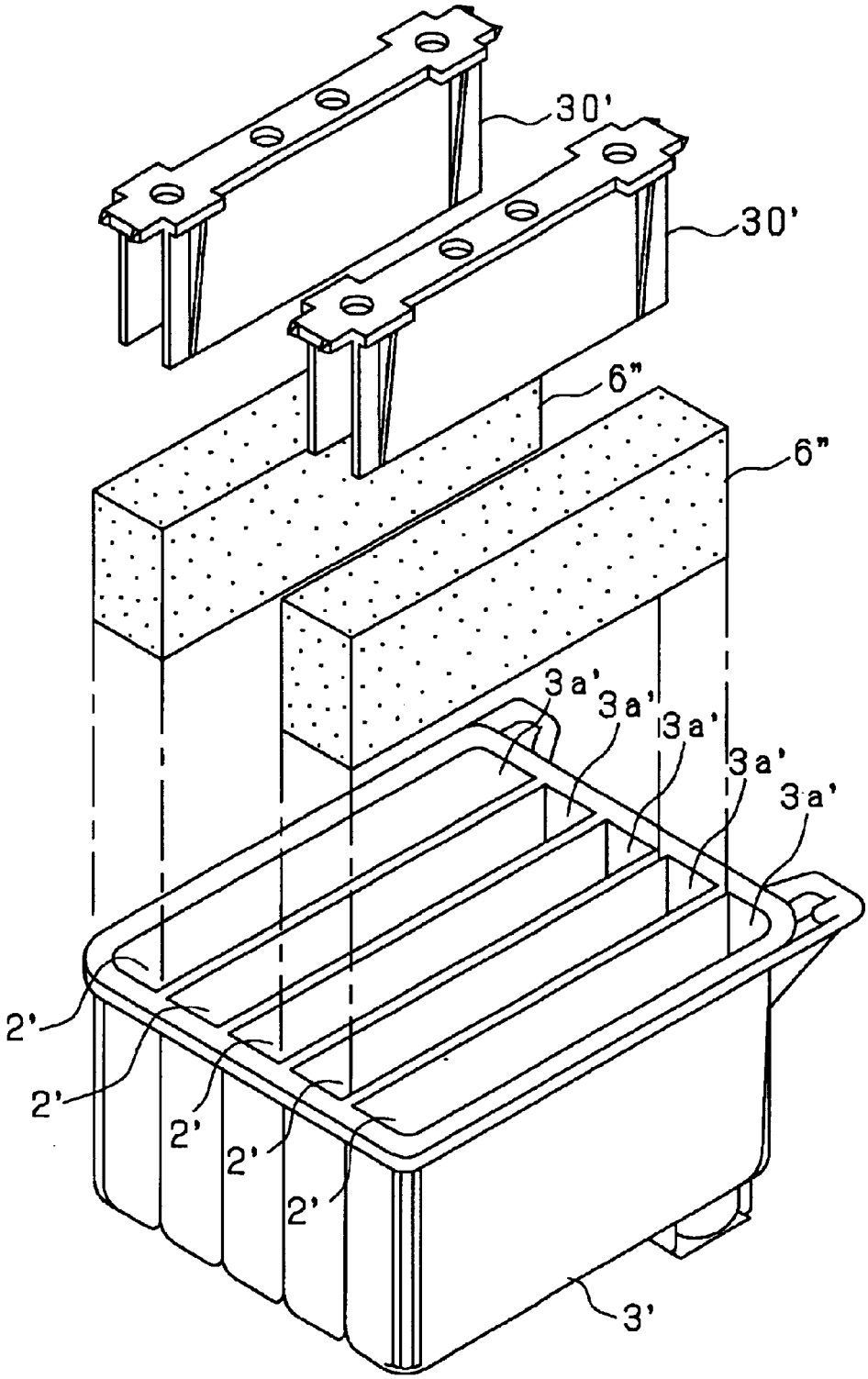
FIG. 9 shows an embodiment with the lid removed to which a method of minimizing an ink cartridge of the present invention is applied.

In the above-mentioned embodiment, the ink cartridge stores one color ink. However, as shown in FIG. 9, it is possible to have the same effect by dividing a container body 3' into a plurality of ink chambers 2' by walls 3*a*', and by inserting ink absorbing members 6" and a spacers 30' constructed as well as the spacer 30 in the ink cartridge. The width of the ink absorbing member 6" corresponds to the size of ink chambers 2'.

According to the first embodiment, a spacer for pressing an ink absorbing member toward an ink supply port is inserted between a lid member and the ink absorbing member, so that the volume for storing ink is decreased without changing structure in the vicinity of the ink supply port by using the same container body and the some lid member which are used for an ink cartridge with a normal volume.

Figure 10A:
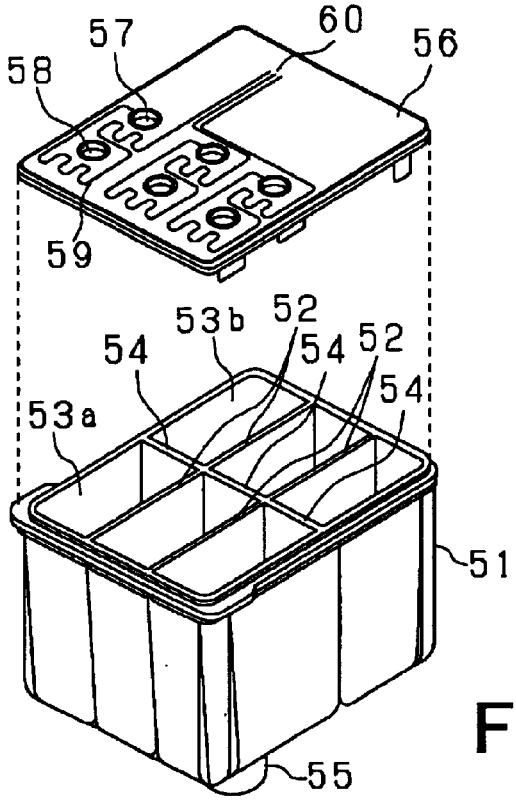
FIGS. 10(*a*) and (*b*) show the second embodiment of an ink cartridge of the present invention by exemplifying a color ink cartridge with a lid member off.
Figure 10B:
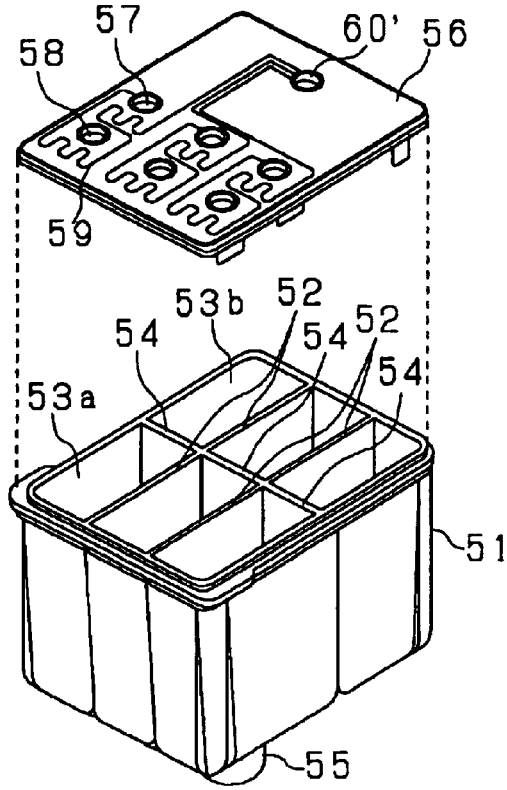
Figure 11A:
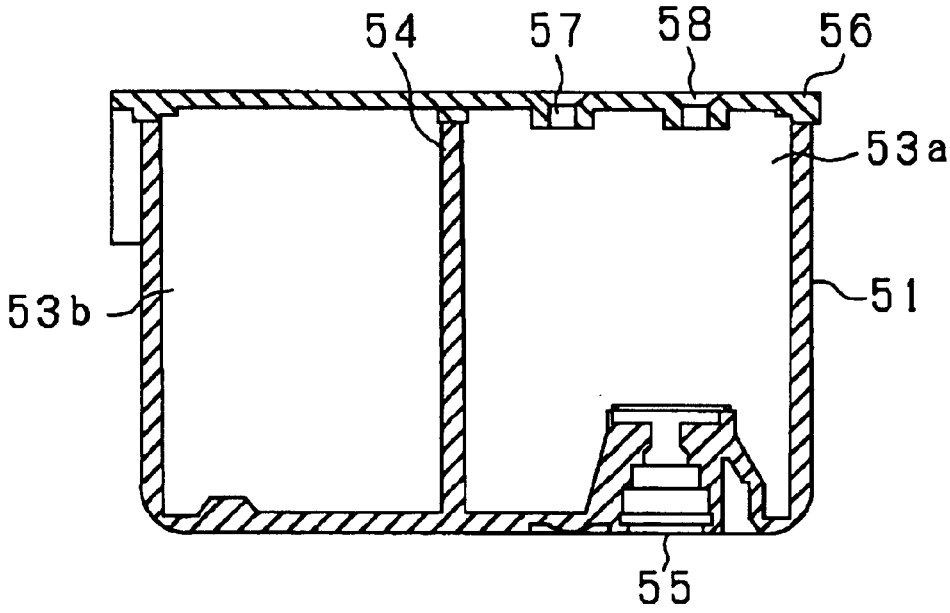
FIGS. 11(*a*) and (*b*) show cross sectional views of one ink storage area in the color ink cartridge.
Figure 11B:
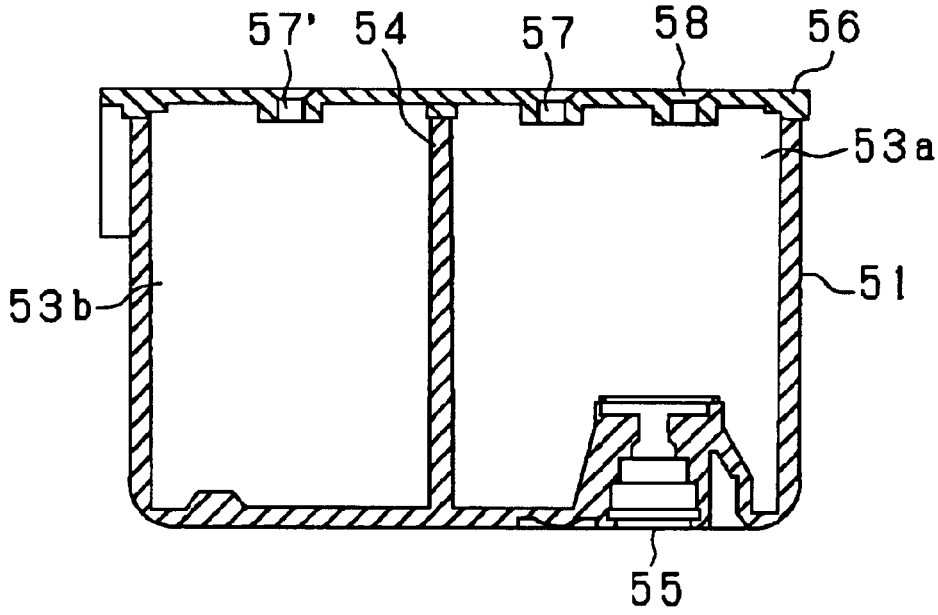

In FIGS. 10 and 11 show the second embodiment in the present invention regarding an ink cartridge for use in an ink jet recording apparatus and exemplify a color ink cartridge. A container body 51 is installed on a cartridge holder in predetermined condition. The container body 51 is divided into according to the number of ink types, or three rectangular parallelepiped chambers in this embodiment by the first walls 52 which are perpendicular to direction of an ink supply needle arranged. Each chamber is further divided into two areas 53*a* and 53*b* by the second walls 54. (This specification includes a rectangular parallelepiped shape whose upper surface slightly opens.)

One of the areas 53*a* divided by the walls 54 is formed as an ink chamber and is provided with an ink supply port 55 on the bottom portion as well as an ink cartridge with a normal volume. At least, the areas 53*a* of the container body 51 storing ink are sealed with a lid member 56. On the lid member 56, ink injecting ports 58 positioned at the areas 53*a* storing ink and an air communicating hole 60 are formed so as to connect via capillary paths. An air communicating paths are formed by sealing narrow grooves 59 with a gas impermeable film.

As shown in FIG. 10(*b*), when the edge of the narrow grooves 59 is formed to be a part of an air communicating hole 60' communicated with one of the cavities 53*b*, negative pressure stored in the cavities 53*b* keeps the areas 53*a* storing ink under negative condition until the gas impermeable film is removed when using the ink cartridge. And, when removing the gas impermeable film, a large opening area is obtained as soon as possible. Therefore, the areas storing ink are ensured to release to the air via the narrow grooves 59. Even if the ink flows to the air communicating hole 60' through the narrow grooves 59 during transportation, the ink is collected to the cavities 53*b* so as to prevent ink leakage outside.

As shown in FIG. 11(*b*), when the same air communicating port 57' as well as the air communicating port 57 is provided with the cavity 53*b* and the ink cartridge is conveyed under reduced pressure in a gas impermeable and airtight package, the volume of the cavity 53*b* is used as space under reduced pressure. Therefore, it is possible to keep the airtight package under reduced pressure even if the ink cartridge is not used soon after manufacturing, and to provide a degassed ink to consumers. When a recording apparatus is used long after it was previously used, it is extremely effective for maintenance of the apparatus. Namely, bubbles entered in a recording head are removed by the degassed ink.

When the cavity 53*b* is sealed with the lid member 56 and air in the cavity swells, the volume of the ink storing area is changed via an adjacent partition wall 54. However, providing the air communicating port 57' prevents this bad influence.

Figure 12:
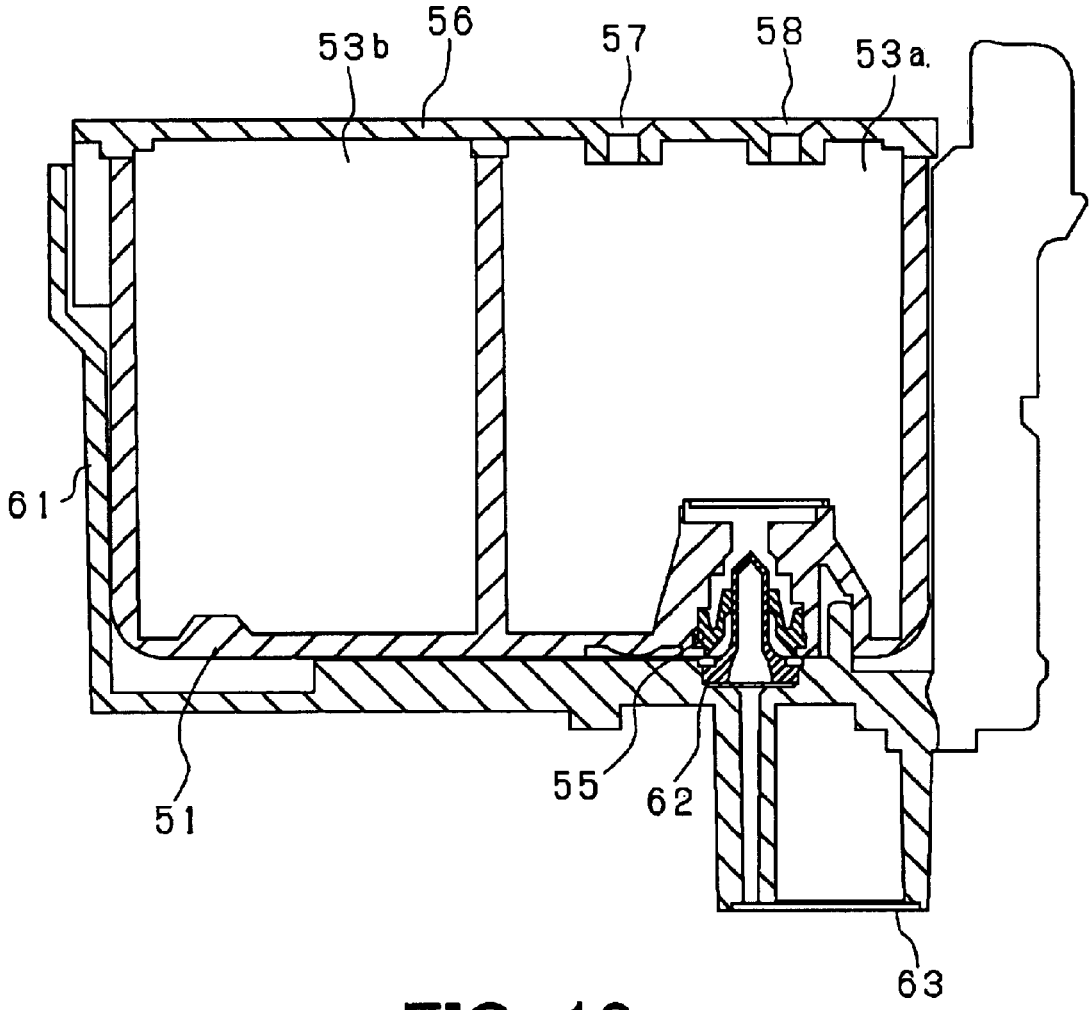

According to this embodiment, as shown in FIG. 12, when an ink cartridge is installed in a cartridge holder 61 and an ink supply needle 62 is inserted into the ink supply port 55, the ink cartridge communicates with a recording head 63 in a condition in which surrounding is maintained by the internal wall of the holder 61. Therefore, ink is ensured to supply to the recording head 63 despite the reciprocation of the cartridge.

Figure 13:
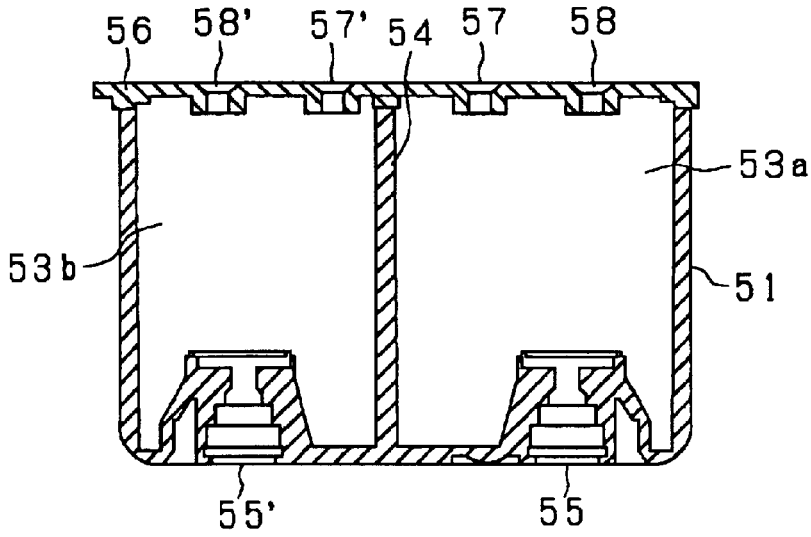
FIG. 13 is a cross sectional view of another embodiment.

In the above-mentioned embodiment, one of the areas divided by the wall 54 is a cavity portion However, as shown in FIG. 13, an ink supply port 55' is formed in the cavity 53. And an air communicating port 57', an ink injecting port 58', and a groove connecting with the air communicating port 57' and forming an air communicating path are provided in the lid member 56. Therefore, even if ink in the area 53*a* is consumed or the effective date of the cartridge after opening a seal expires, another area is not opened yet so that it is possible to use ink in another area effectively.

When maintenance liquid instead of ink is filled in the area 53*b,* any inconveniences such as nozzle clogged with solid ink are prevented by filling the maintenance liquid in a recording head in the case that printing is obviously not executed for a long time. It is preferable to seal the ink supply port 55, in which an ink supply needle is inserted, with a valve so as to prevent ink leakage or ink vaporization.

Figure 14:
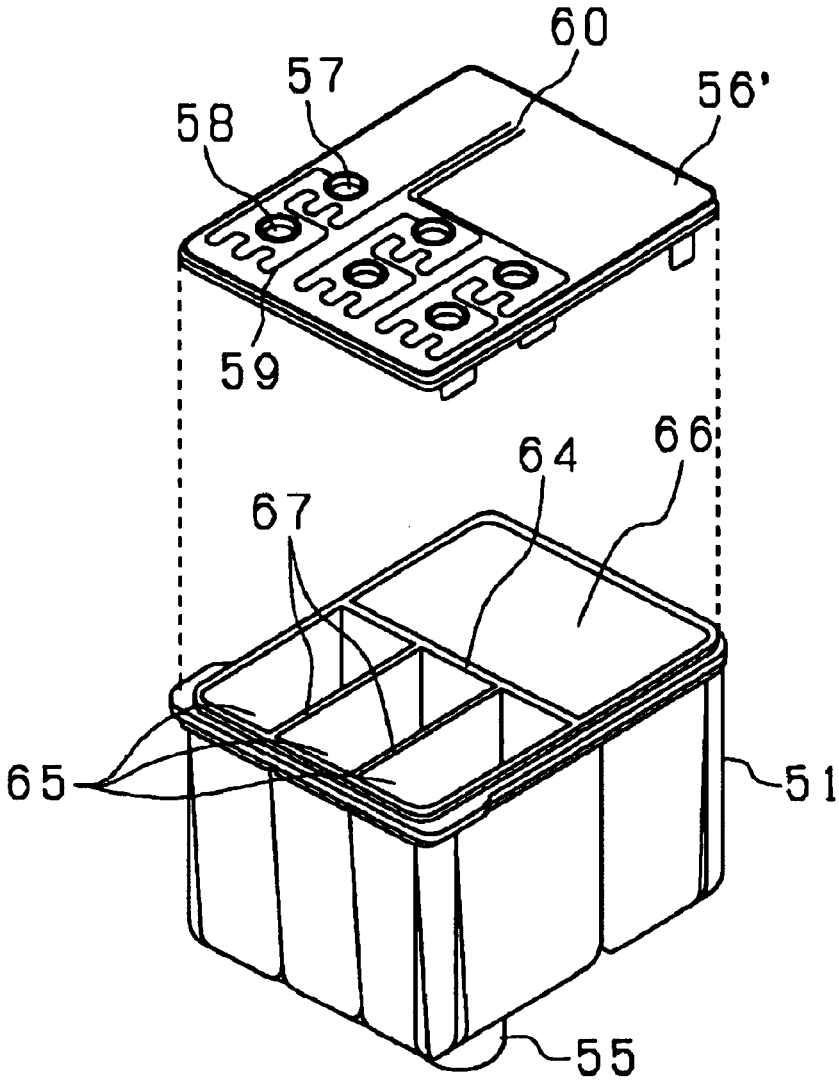
FIG. 14 exemplifies another embodiment of a color ink cartridge.

In the above-mentioned embodiment, the whole container body is divided according to the number of ink supply ports, and the divided container body is further divided into ink storing areas and cavities by the walls 54. However, as shown in FIG. 14, the container body may be divided into ink storing areas 65 and a cavity 66 by a common wall 64 so that the ink storing areas are only divided according to the number of kinds of inks by walls 67.

Figure 15A:
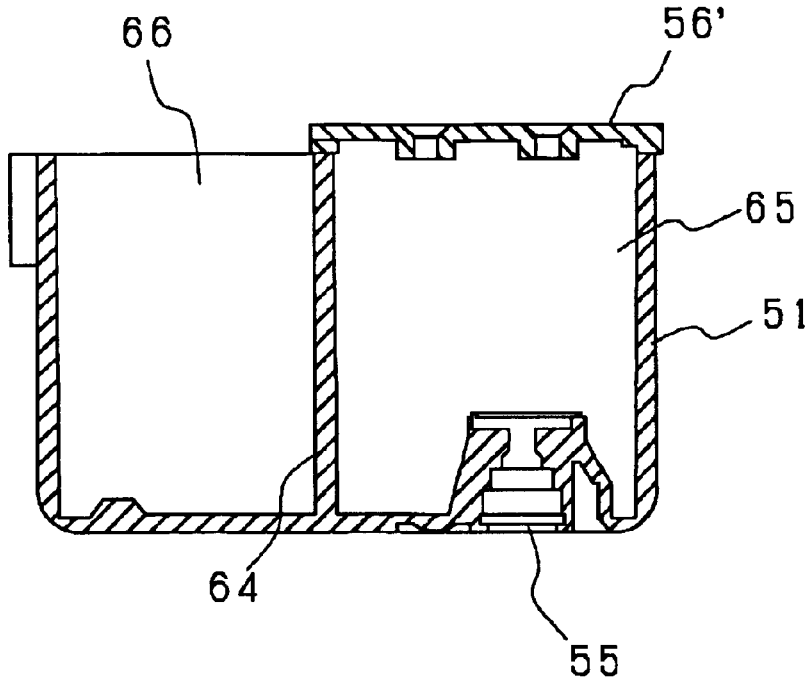
FIGS. 15(*a*) and (*b*) are cross sectional views of another embodiments respectively.
Figure 15B:
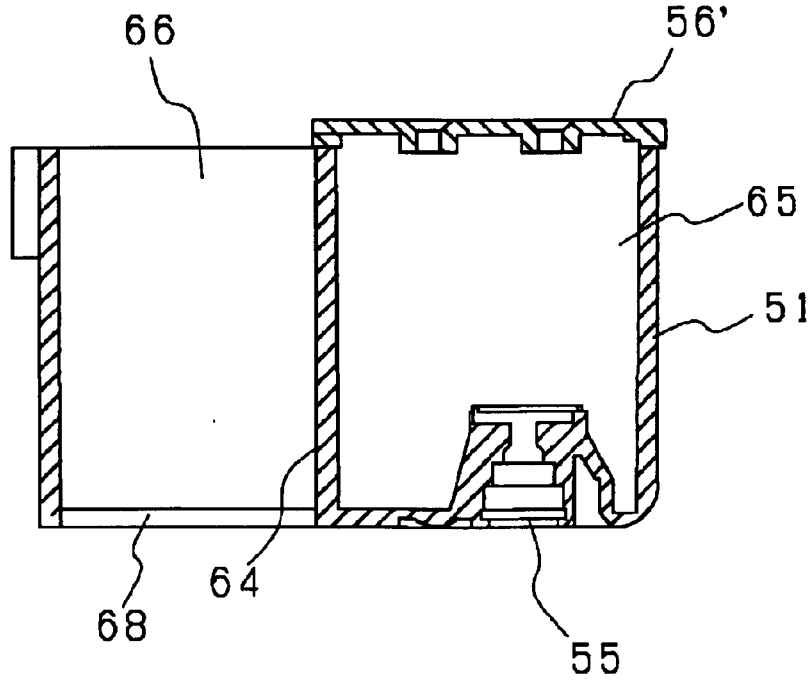

In the embodiment, the lid member 56 seals the whole container body. However, it is possible to seal only the ink storing areas 65 with a lid member 56' so as to open a cavity area 66 as shown in FIG. 15(*a*), and to form an opening 68 on the bottom of the cavity area so as to be cylinder.

In the second embodiment, an ink cartridge comprises a container body installed in a holder of a carriage, and an ink chamber communicating with a recording head via an ink supply needle of the recording head and an ink supply port. The internal space of the container body is divided into a plurality of walls, and ink is stored in at least at one area where the ink supply port is provided. Therefore, it is possible to use the same container body storing normal ink volume and to decrease the volume of the ink stored area. It is also possible to produce an ink cartridge whose ink volume is suitable for small printing without any inconveniences cased by carriage movements.

Figure 16:
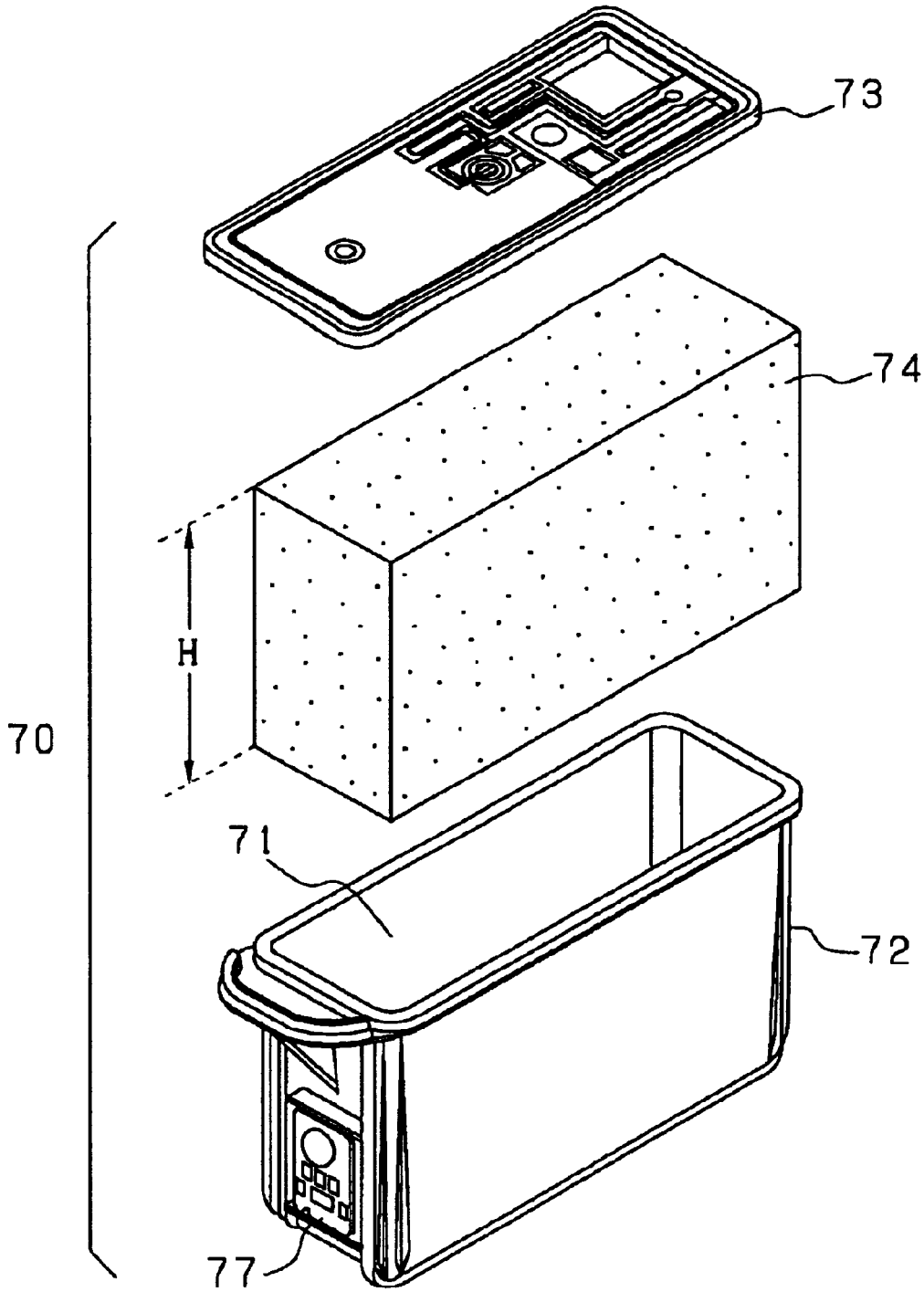
FIGS. 16 and 17 are perspective assembly views of the third embodiment of an ink cartridge and show the ink cartridge with a normal volume and minimized volume, respectively.
Figure 17:
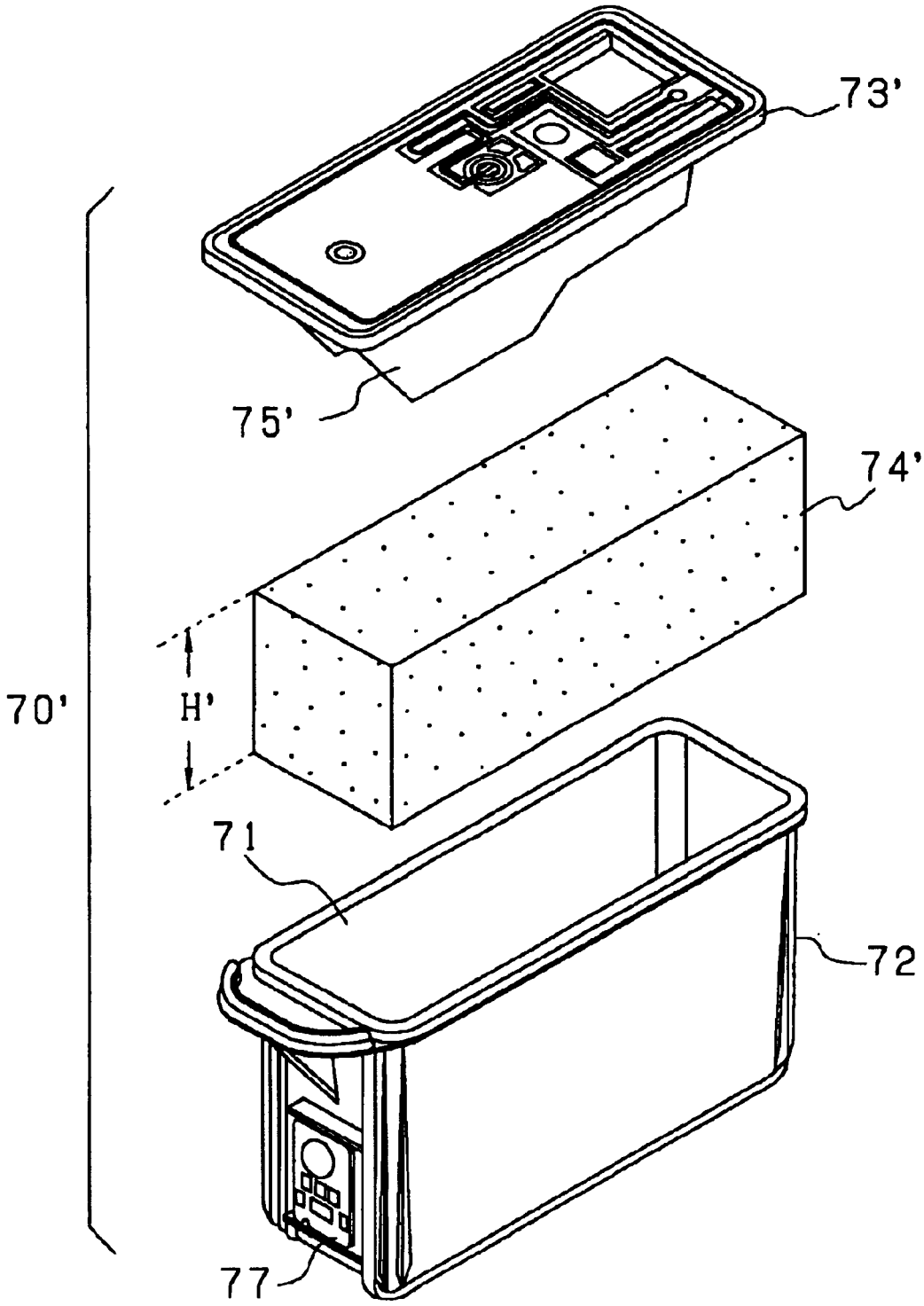

FIGS. 16 and 17 show the third embodiment of an ink cartridge for use in an ink jet recording apparatus in which an ink absorbing member absorbs ink.

An ink cartridge 70 comprises a container body 72 made from polymer material so as to form an ink chamber 71 for obtaining a substantially rectangular parallelepiped space therein, and a lid member 73 sealing an opening of the container body 72. In the container 72, a substantially rectangular parallelepiped ink absorbing member 74 is inserted so as to absorb the ink.

Figure 18A:
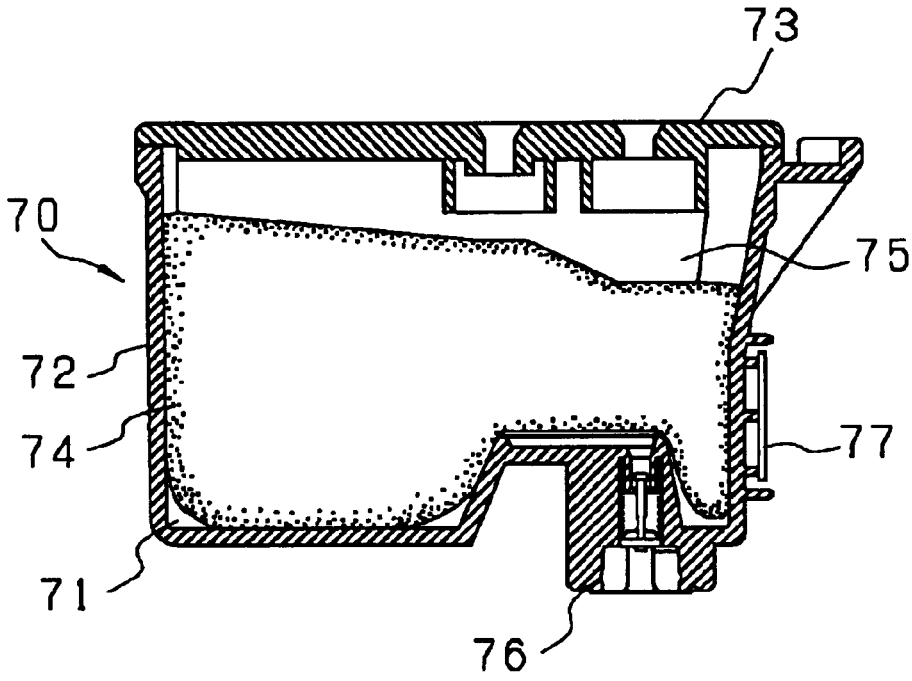
FIGS. 18(*a*) and (*b*) are cross structural views showing an ink cartridge with a normal volume and with minimized volume, respectively, in which an ink absorbing member absorbs ink.
Figure 18B:
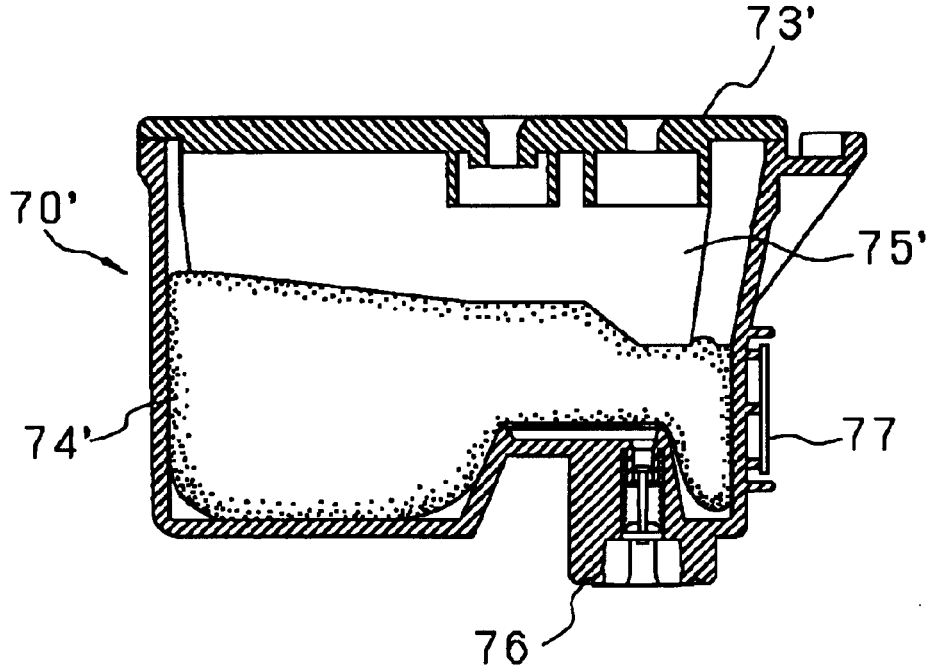

FIG. 18(*a*) shows the ink absorbing member 74 pressed in the vicinity of an ink supply port 76 by a rib 75 formed at the opposite area to the ink supply port 76 and at the back of a lid member 73. Therefore, since capillary action in the vicinity of the ink supply port 76 is high, peripheral ink is attracted to the ink supply port 76 and ink in the ink absorbing member 74 is ensured to supply to a recording head.

In the case ink volume is minimized in such an ink cartridge, while cross sectional shapes are substantially the same as shown in FIGS. 17 and 18(*b*), an ink absorbing member 74' whose height H' is lower than the height H of the ink absorbing member 74 is inserted into the container body 72, and an opening portion of the container body 72 is sealed with a lid member 73' having a rib 75' with predetermined height for pressing the ink absorbing member toward the ink supply port 76.

In such a minimized ink cartridge 70', a shape in the vicinity of the ink supply port 76 is formed to be substantially the same as that of the ink cartridge with a normal volume, so that function of ink supply is not changed. Moreover. since a metallic mold used for producing the ink cartridge 70 with a normal volume is commonly used, two types of cartridges are provided without increasing costs.

In the case the recording apparatus controls the amount of ink supplied to the recording head from the ink cartridge, it is necessary to recognize that the cartridge is manufactured for the one with a small volume. As shown in FIGS. 16 to 19, a circuit board 77 having a storage device, which is readable from the recording apparatus, is attached to the ink cartridge. And, writing information regarding the amount of ink in the storage device makes the recording apparatus recognize the specification of the ink cartridge.

The information regarding the amount of the ink may include not only the amount of ink to be supplied to the recording head from the cartridge, but also the amount of ink filled with the ink cartridge.

When the storage device mounted on the circuit board 77 is a writable or rewritable one, the amount of used ink in the storage device is written by the recording apparatus. Therefore, residual ink in the recording apparatus is accurately recognized, even if the ink cartridge is reattached after being detached from a cartridge holder.

In the third embodiment, an ink cartridge comprises a container body installed in a holder of a carriage, and an ink chamber communicating with a recording head via an ink supply needle of the recording head and an ink supply port. The ink chamber houses an ink absorbing member so as to absorb ink. A lid member seals an opening portion of the container body. Ribs are formed in the back of the lid member so as to be opposed at least to the ink supply port for pressing the ink absorbing member toward the ink supply port. Ink volume is adjusted according to the volume of the ink absorbing member. Therefore, it is possible to adjust the ink volume by changing the volume of the ink absorbing member by using the same container body of the ink cartridge with a normal volume. It is also possible to produce an ink cartridge which is suitable for small printing without any inconveniences caused by carriage movements.

Figure 19:
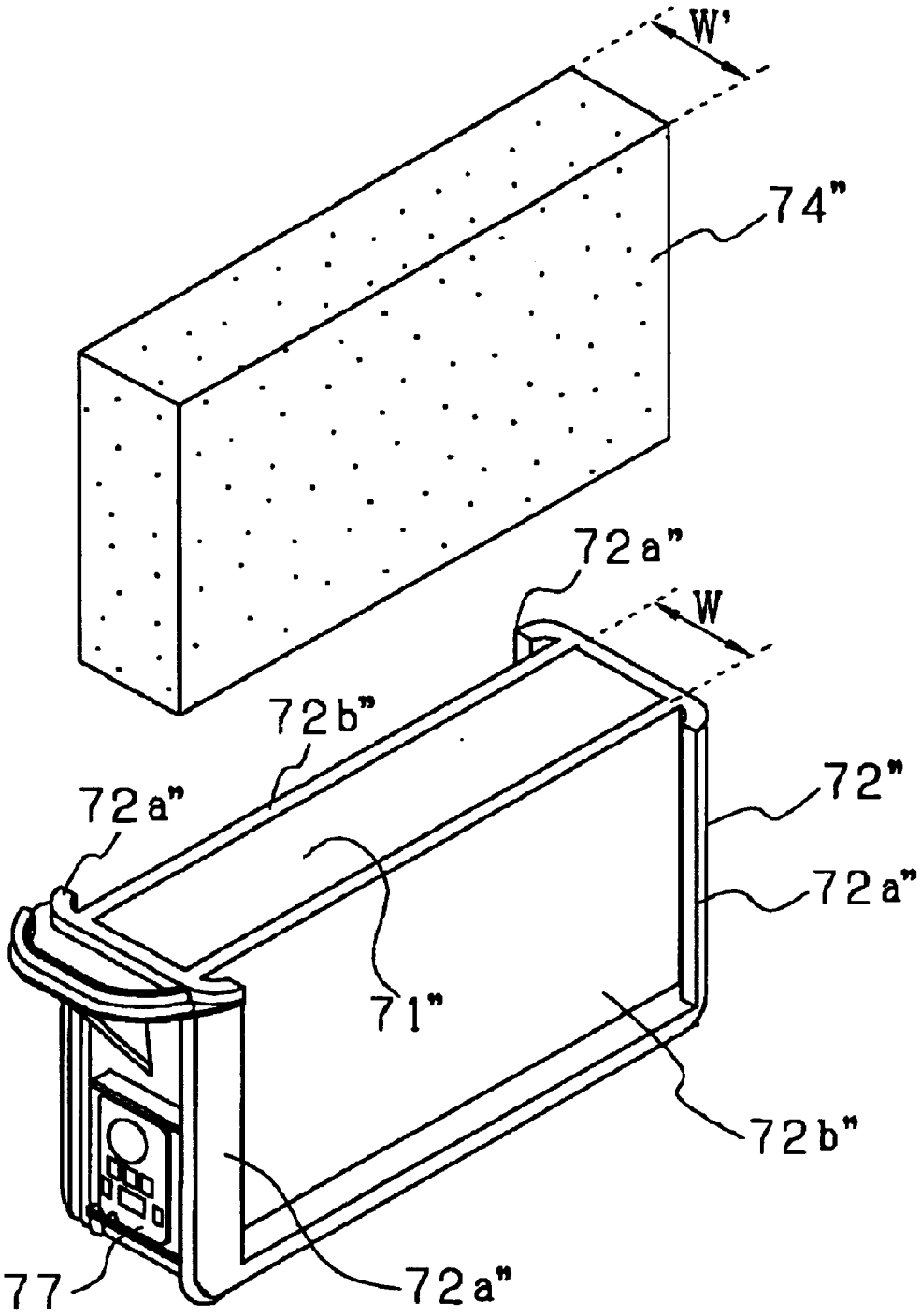
FIG. 19 shows a perspective assembly view showing a fourth embodiment for minimizing an ink cartridge in which an ink absorbing member absorbs ink.
Figure 20:
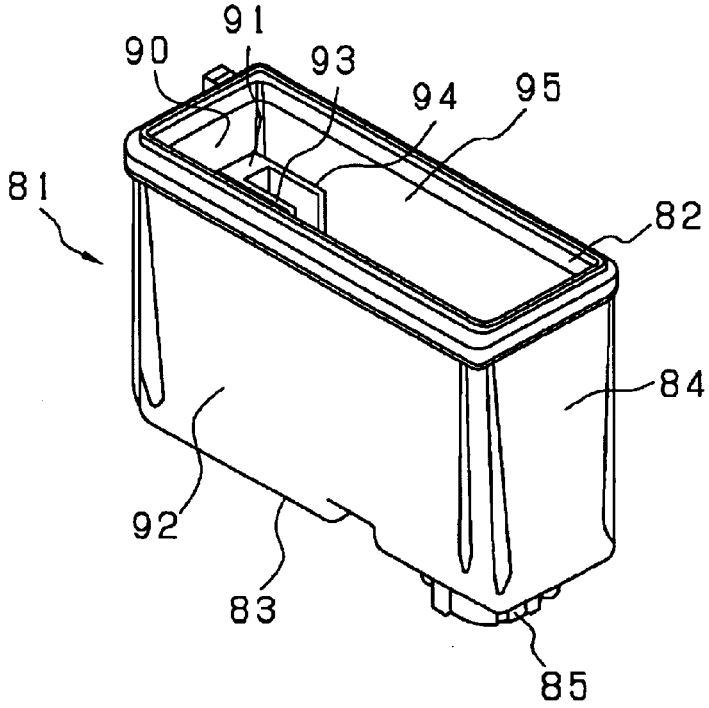
FIG. 20 shows the fifth embodiment in which the lid member of the ink cartridge is removed.

FIG. 19 shows the fourth embodiment. As shown in FIG. 19, while an area 72*a*" positioning a cartridge against a cartridge holder is maintained as the container body 72 with a normal volume (FIG. 17), the width W of an ink chamber 71" is narrowed, namely a side wall 72*b*" is positioned to be inside from an outer shape. And an ink absorbing member 74" with the width W' corresponding to the width W is housed and sealed, thereby bringing the same effect.

FIGS. 20 to 24 show the fifth embodiment and exemplify a cartridge having one type of ink, such as black ink. A container body 81 composing an ink cartridge is removably mounted on a cartridge holder in a carriage and is formed to be a rectangular parallelepiped so as not to clatter in the holder. This specification includes a rectangular parallelepiped shape whose upper surface slightly opens.) On the upper surface an opening 82 is provided. On the bottom surface 83, an ink supply port 85 is formed and located at the side of a short side wall 84 of the container body 81 so as to supply ink by communicating with a recording head. On the bottom portion 86 of the container body 81, a convex portion 88 having an ink outflow port 87 communicating with the ink supply port 85 is formed, and a filter 89 is provided thereon.

A concave portion 91 is formed at one short side wall 90 of the container body 81 so as to extend from a bottom portion 86 to below the container body. The concave portion 91 has narrower width W2 than the width W1 of the short side. The concave portion 91 functions to position the container body 81 against a pallet during manufacturing, guide the container body 81 against the cartridge holder, and prevent insertion of the container body 81 into the cartridge holder by mistake.

Making the ink cartridge with a small volume in this embodiment, the same ribs 93 and 94, which are parallel to a long side wall 92 and protrude to the internal of the container body 81, are formed at a surface 91*a* of the concave portion 91.

Figure 24A:
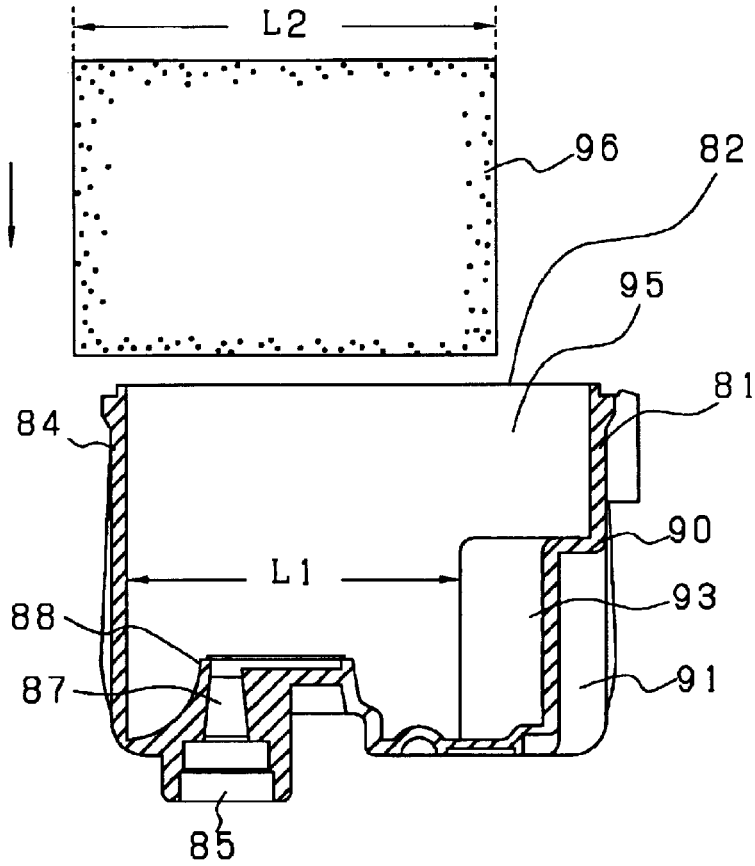
FIGS. 24(*a*) and (*b*) show an assembly process of the ink cartridge.
Figure 24B:
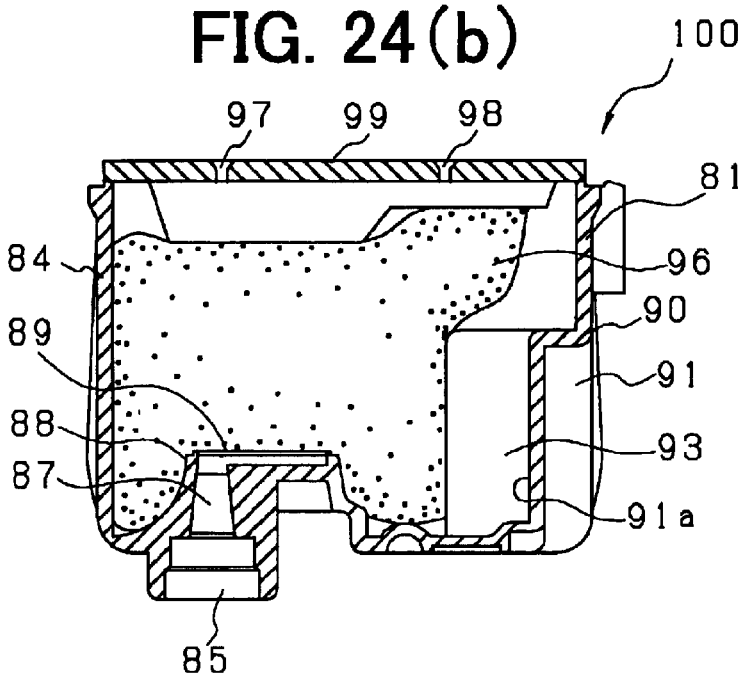

In space of the container body, namely in an ink chamber 95 as shown in FIGS. 24(*a*) and (*b*), a rectangular parallelepiped ink absorbing member 96 made of an elastic ink absorbing member is inserted from the opening 82. After the opening 82 is sealed with a lid member 99 on which an injecting port 97 and an air communicating port 98 are formed, ink is injected by press fit from the ink injecting port 97 to the ink absorbing member 96 so that an ink cartridge 100 is completed. In the above-mentioned embodiment, since the two ribs 93 and 94 are formed in parallel, the ink absorbing member 96 is inserted by the press fit without sliding.

Figure 21:
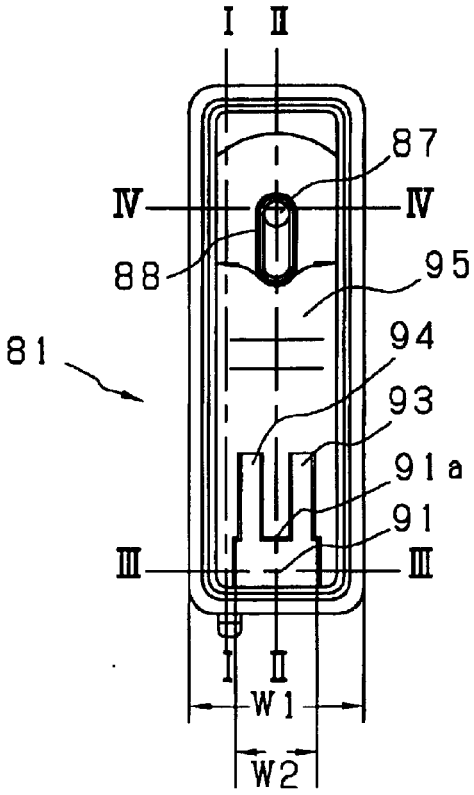
FIG. 21 is the upper surface view showing the structure of a lower area below a concave portion of the ink cartridge.
Figure 22A:
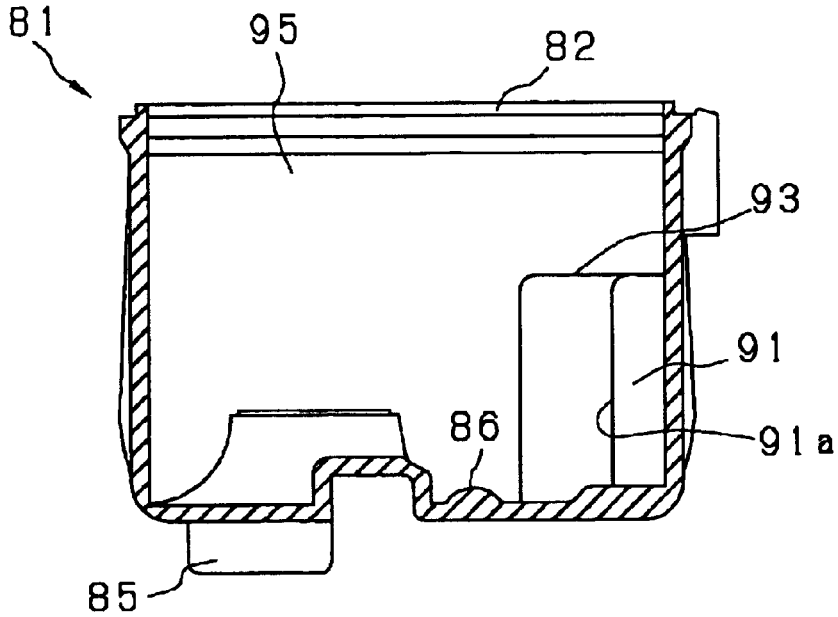
FIGS. 22(*a*) and (*b*) show sectional views along the lines I—I and II—II in FIG. 21.
Figure 22B:
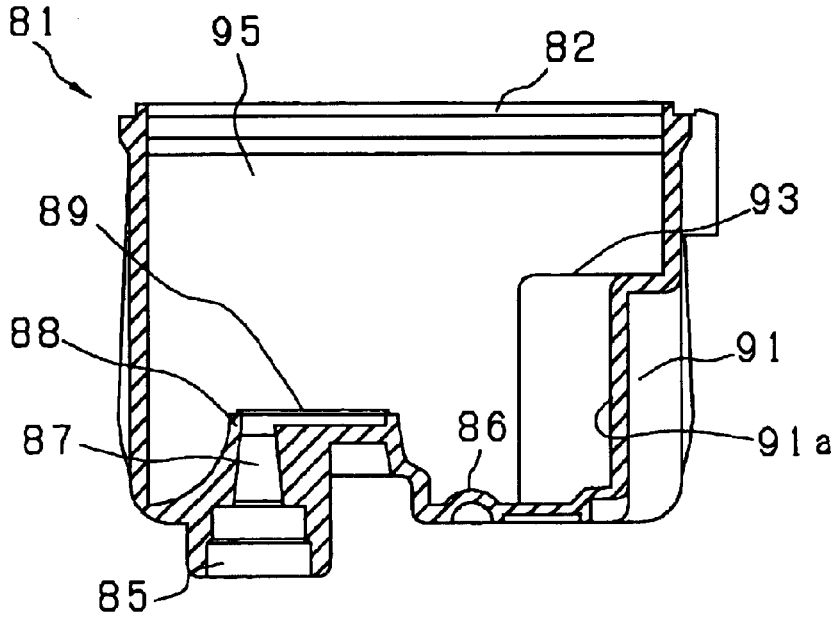
Figure 23A:
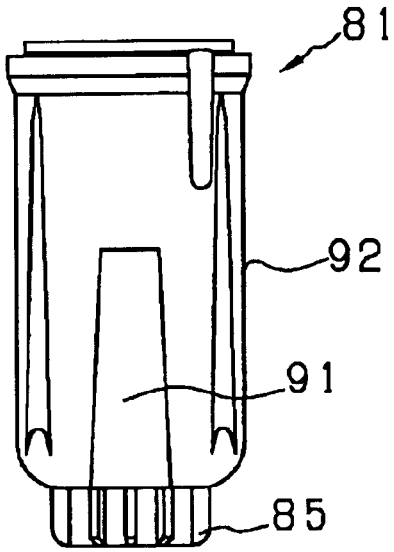
FIGS. 23.(*a*) to (*c*) show a side view and structural views in section along the lines III—III and IV—IV of FIG. 21, respectively.
Figure 23B:
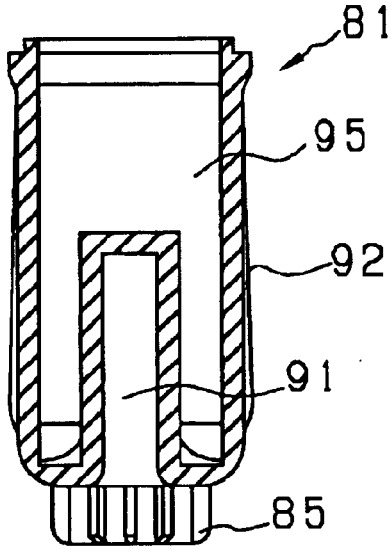
Figure 23C:
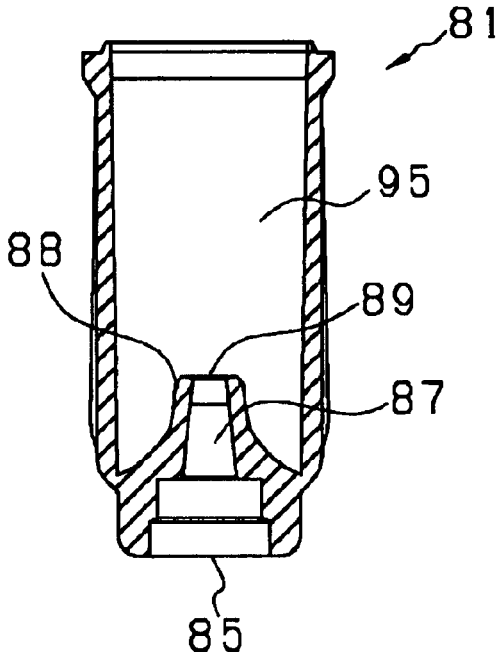

As shown in FIG. 21, the ink absorbing member 96 is slightly larger than the width W1 of the opening 82 in the container body 81. As shown in FIG. 24(*a*), the length L2 of the ink absorbing member 96 is slightly larger than the length L1 showing the distance from the side wall 84 having the ink supply port 85 to the leading edge of the ribs 93 and 94. Therefore, as shown in FIG. 24(*b*), when the container body is sealed with a lid member 99, the ink absorbing member 96 is strongly compressed. Strong capillary action works at the leading edge of an ink outflow port 87, namely the ink absorbing member is more strongly compressed at the area contacting with a filter 89 by a concave portion 88 than other areas.

The ink absorbing member 96 is compressed in the vicinity of the ink supply port 85 so as to be the same shape as that of an ink cartridge with a normal volume (FIG. 25(*a*)) having no ribs as described later. The other edge of the ink absorbing member 96 having no influence on flowing ink is pressed by the ribs 93 and 94 (see FIG. 21), so that even if the ink absorbing member 96 has less capacity to absorb ink, the ink cartridge with a small volume has the same ink supply characteristics as well as those of the ink cartridge with a normal volume.

These ink container bodies 81 are usually manufactured by injection molding of polymer material, so that an internal and an external metallic molds are prepared. Accordingly, the external metallic mold is commonly used for the container body 81 with a normal volume. As to the internal metallic mold, a slight redesign, such as adding a convex portion for injecting resin to form the ribs 93 and 94, produces a container body for the ink cartridge with a small volume. Even if a cartridge is minimized, the external shape is not changed. Therefore, a manufacturing line for the ink cartridge with a normal volume is also used for that with a small volume, thereby decreasing the cost of equipment.

Figure 25A:
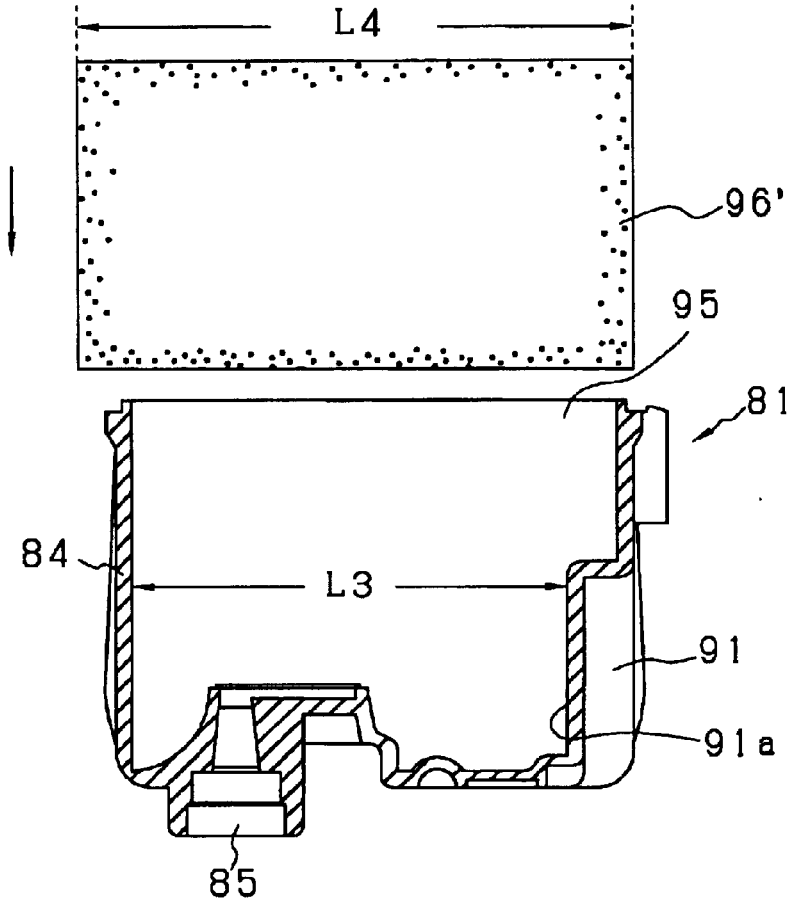
FIGS. 25(*a*) and (*b*) show an assembly process for constructing the ink cartridge used for the ink cartridge with a normal volume.
Figure 25B:
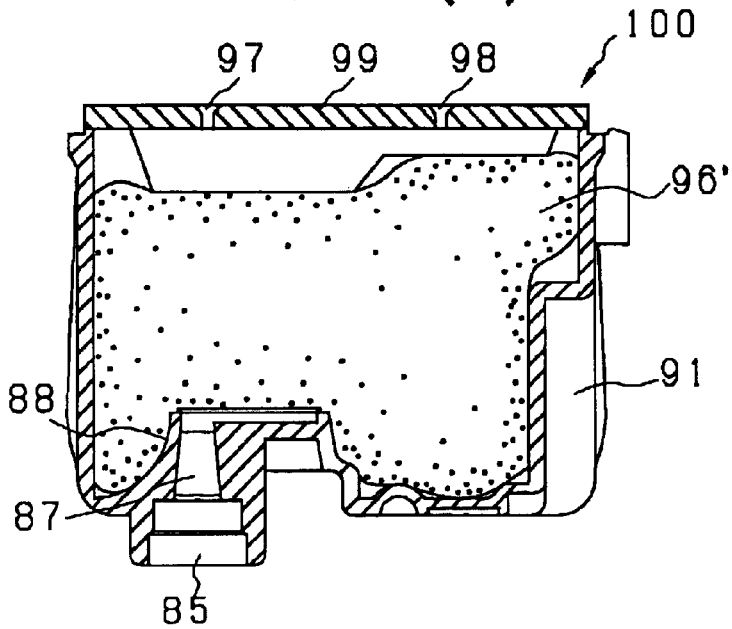

Namely, the width of the ink cartridge with a normal volume, as shown in FIG. 25(*a*), is the same as that of the ink cartridge with a small volume. However, the length L4 of the ink absorbing member 96' is larger than the length L3 showing the distance from the short side wall 84, at which the ink supply port 85 is provided, to the other, side wall 90. Accordingly, as shown in FIG. 25(*b*), when the container body 81 is sealed with the lid member 99, the ink absorbing member is compressed at the ink supply port 85 side in the same shape as well as that of the ink cartridge with a small volume in which the ribs 93 and 94 are provided.

Peripheral structure of containers with a normal volume and with a small volume is the same, so that the structure is applied to an ink cartridge storing plural kinds of inks, such as a color ink cartridge.

Figure 26:
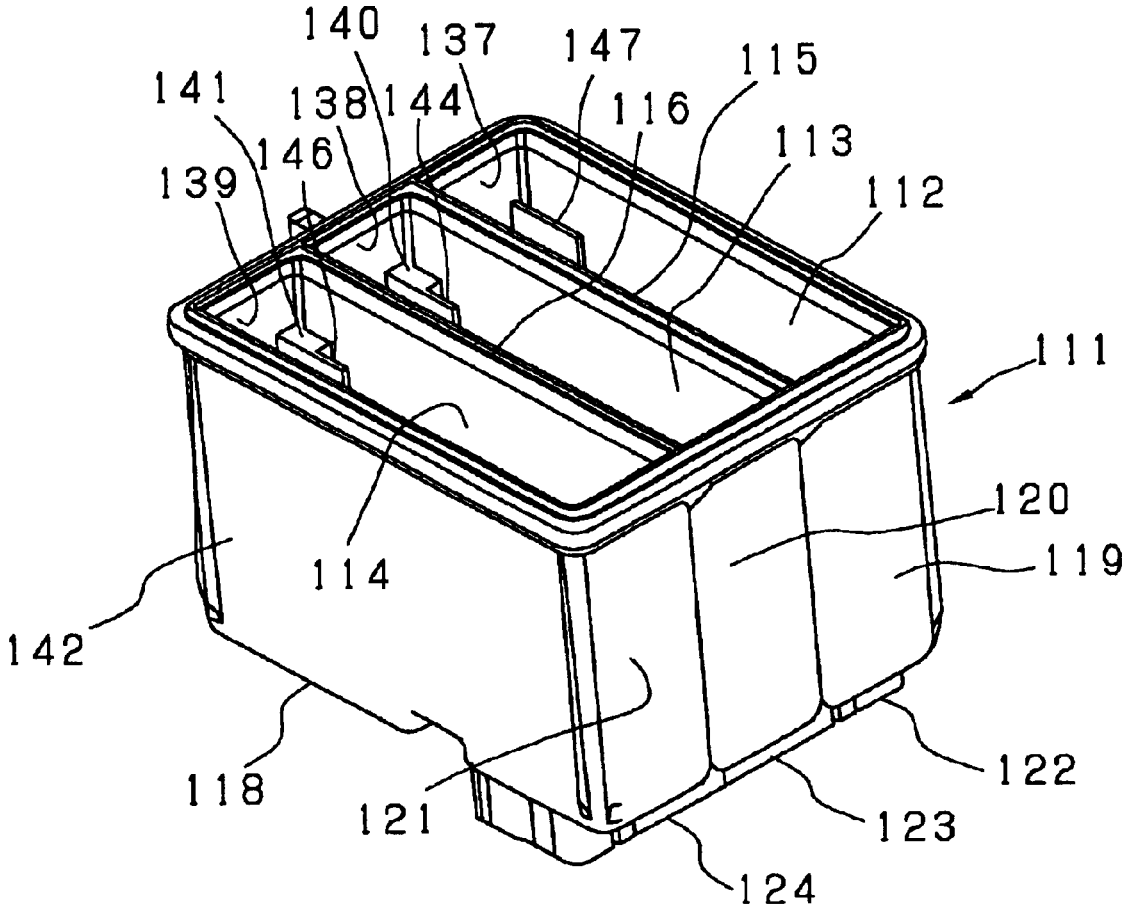
FIG. 26 shows a container body with a lid off constituting another embodiment.
Figure 27A:
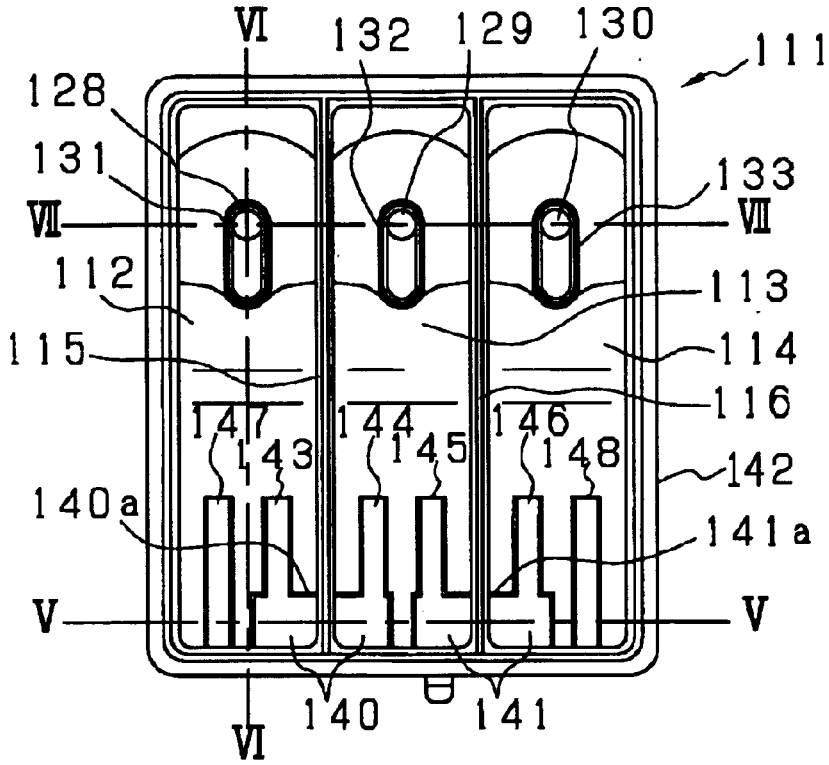
FIGS. 27(*a*) and (*b*) are the upper view showing a lower part of a sixth embodiment of an ink cartridge housing plural kinds of inks and a side view the ink cartridge, respectively.
Figure 27B:
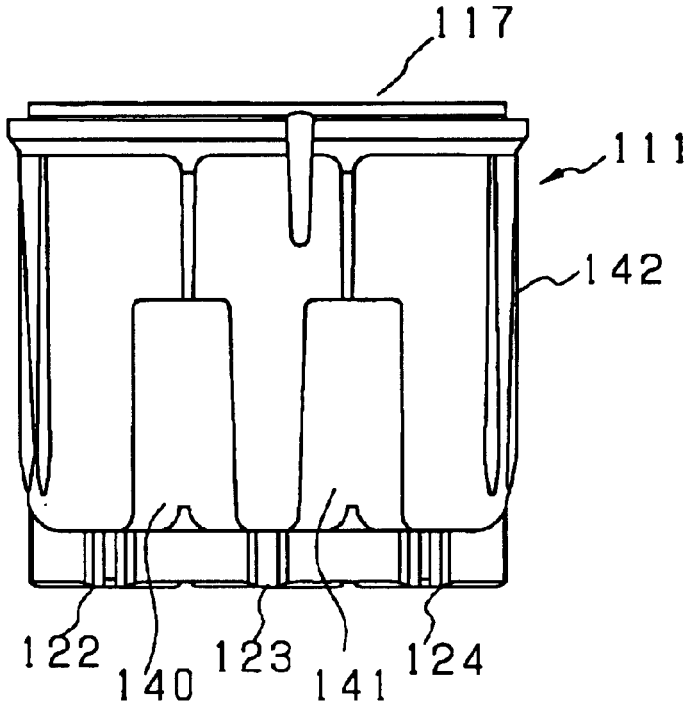
Figure 28A:
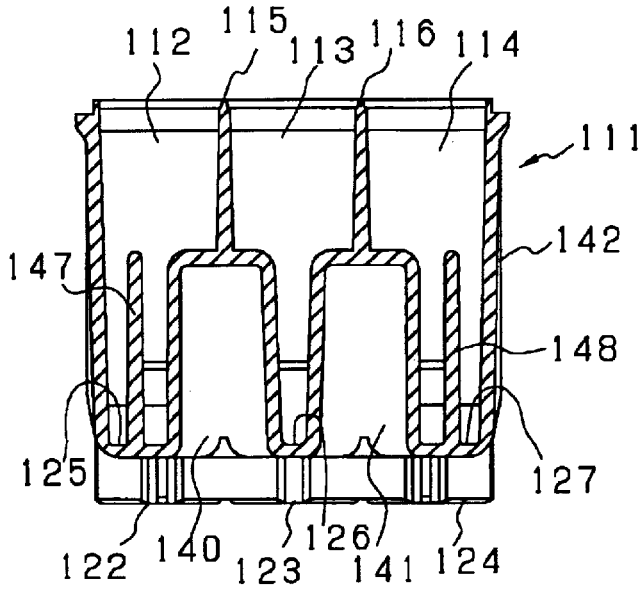
FIGS. 28(*a*) to (*c*) show structural views in section along the lines V—V, VI—VI and VII—VII in FIG. 27(*a*), respectively.
Figure 28B:
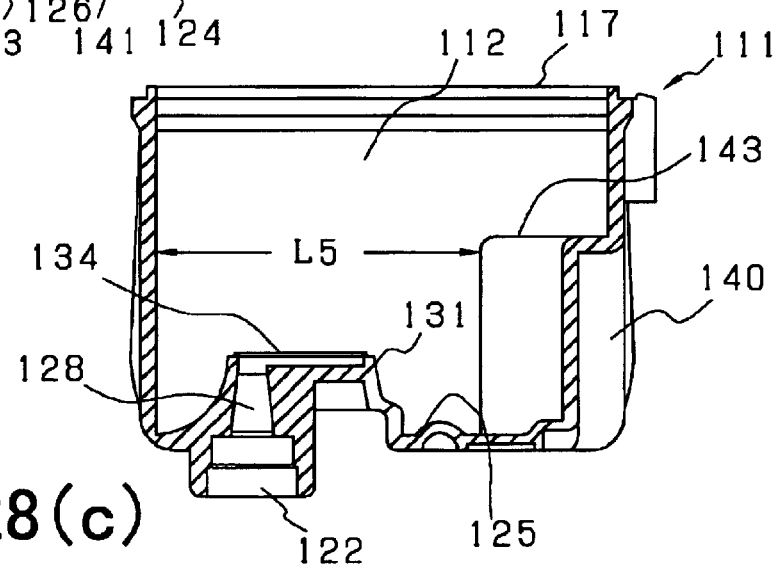
Figure 28C:
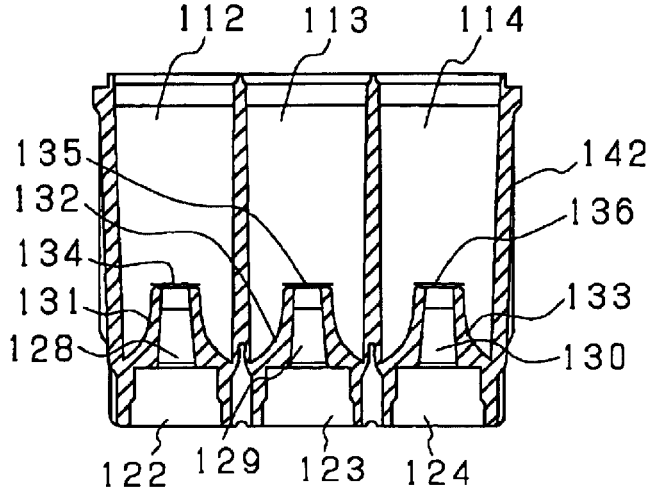

Namely. FIGS. 26, 27(*a*)–(*b*) and 28(*a*)–(*c*) show a sixth embodiment showing plural kinds of inks stored in one ink cartridge. A container body 111 is removably mounted on a cartridge holder of a carriage and formed to be a rectangular parallelepiped so as not clatter in the holder. In this embodiment, partitions 115 and 116 are formed so as to divide three ink chambers 112, 113, and 114.

On the container body 111 an opening 117 is provided. On a bottom portion 118, ink supply ports 122, 123 and 124 are formed at short aide walls 119, 120 and 121 of each ink chambers 112, 113 and 114 so as to supply ink to a recording head. On bottom surfaces 125, 126 and 127 of each ink chambers 112, 113 and 114, convex portions 131, 132 and 133 having ink outflow ports 128, 129 and 130 are formed. The ink outflow ports 128, 129 and 130 communicate with the ink supply ports 122, 123 and 124, and filters 134, 135 and 136 cover thereon.

The other shorter side walls 137, 138 and 139 of each ink chambers 112, 113 and 114 are provided with concave portions 140 and 141 extending from the bottom to half below container body 111 so as to be symmetric at the partitions 115 and 116. The concave portions 140 and 141 function to position the container body 111 against a palette during manufacturing, guide the container body 111 against the cartridge holder, and prevent insertion of the container body 111 into the cartridge holder by mistake.

As shown in this embodiment, when an ink cartridge with a small volume is formed, two pair of ribs 148 and 144, and 145 and 146 are formed in the container body 111 so as to be the same shape. The ribs 143, 144, 146 and 146 protrude from surfaces 140*a* and 141*a* and are parallel to long side walls 142 and 142.

The longer side walls 142, which are a partition wall of the ink chambers 112 and 114, directly extend from shorter side walls. Ribs 147 and 148 are formed parallel to the ribs 143, 144, 145 and 146 so as to set the leading edge of the ribs 147 and 148 at the same position of the leading edge of the ribs 143, 144, 145 and 146 formed in the concave portions 140 and 141.

Figure 29A:
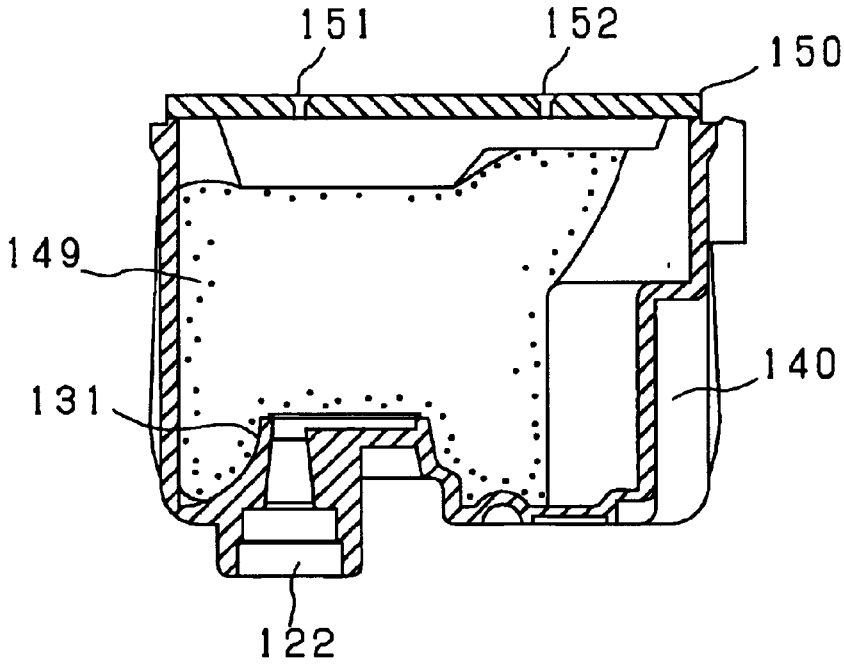
FIGS. 29(*a*) and (*b*) are cross sectional views showing the ink cartridge with a small volume and normal volume for storing plural kinds of inks, respectively.
Figure 29B:
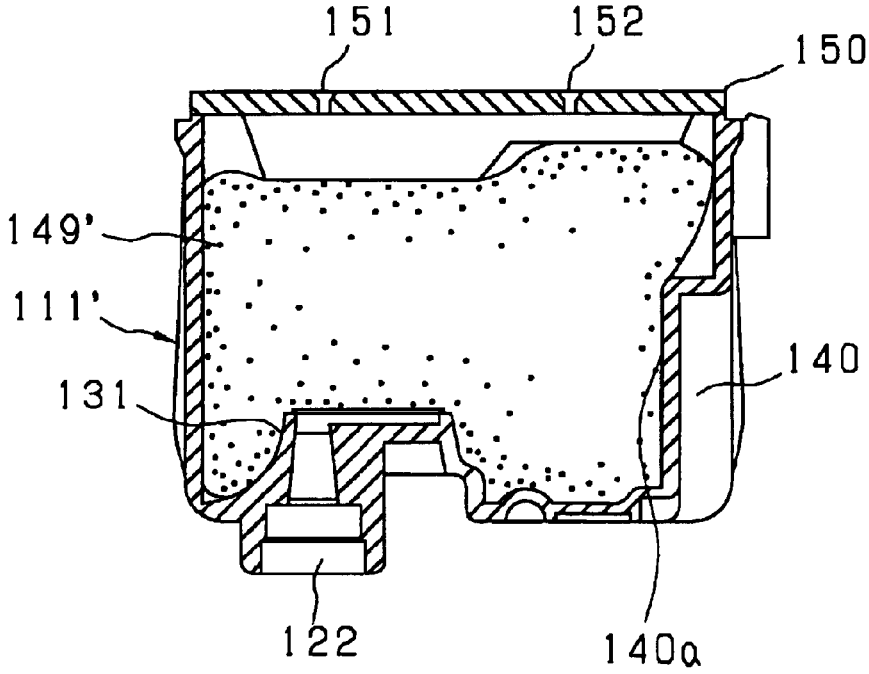

When an ink cartridge with a small volume is formed in this embodiment [FIG. 29(*a*)], an ink absorbing member 149 is inserted. The length of the ink absorbing member 149 is longer than L5 showing the distance from the leading edge of the ribs 143, 144, 145, 146, 147 and 148 to the opposite side wall as described in the previous embodiment. When an ink cartridge with a normal volume is formed, an ink absorbing member 149' is inserted into an container body 111' having no ribs 143, 144, 145, 146, 147 and 148. The length of the ink absorbing member 149' is larger then the distance from the surface 140*a* and 141*a* of the concave portions 140 and 141 to the opposite wall surface having the ink supply port. Reference numeral 150 denotes a lid member in which an ink injecting port 151 and an air communicating port 152 are formed.

In these ink cartridges with small and with a normal volume, as well as in the previous embodiment, the ink absorbing members 149 and 149' are compressed in the same shape at the convex portions 131, 132 and 133 communicating with the ink supply ports 122, 123 and 124, so that the same characteristics of ink supply is maintained despite of the ink stored capacity.

In the above-mentioned embodiment, the container body is provided with two pairs of ribs. However, it is possible to maintain the same ink supply characteristics effect by forming one rib, or three or more than three ribs in the ink chamber so as not to generate unnecessarily a large gap therein.

In the above-mentioned embodiment of a cartridge for use in color ink, there explains three types of inks stored. However, it is obvious for an ink cartridge storing four or more than four kinds of inks to bring the same effect.

As explained above, in the sixth embodiment, an ink cartridge comprises a substantially parallelepiped container body installed in a holder of a carriage, and an ink chamber communicating with a recording head provided in the carriage via an ink supply needle of the recording head and an ink supply port. The ink supply port is provided at one short side wall of the container body. At the other short side wall, a concave portion is provided so as to protrude to the ink chamber. At the concave portion, a rib is formed so as to be parallel to a long side wall and to protrude to the ink supply port. An ink absorbing member comprising an elastic ink absorbing member and having the length corresponding to an ink chamber is supported by the other side wall and the rib. Therefore, since the ink absorbing member is compressed at the ink supply port so as to be the same shape as well as that of the ink cartridge with a normal volume having no ribs, the same characteristics of ink supply is brought. It is possible to manufacture a container body of an ink cartridge with less ink volume by slightly redesigning a metallic mold for use in the container body with a normal volume. Outer shape of the ink cartridge of the container body is maintained so as to be the same as that of the ink cartridge with a normal volume. Therefore, a change of a manufacturing line is not necessary and manufacturing cost may be decreased.

Figure 30A:
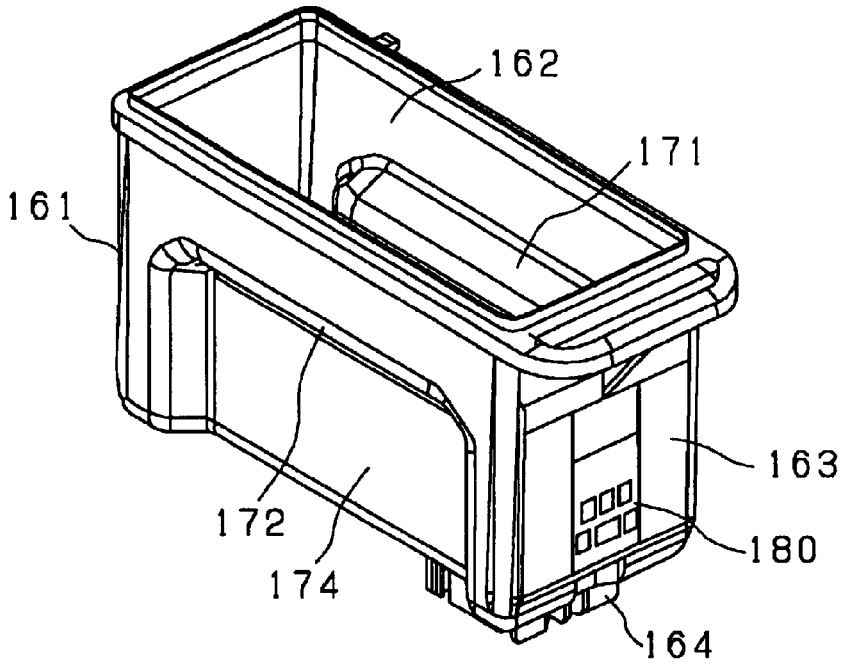
FIGS. 30(*a*) and (*b*) show the seventh embodiment of the present invention, and are perspective views with a lid member off and of the bottom structure of the ink cartridge, respectively.
Figure 30B:
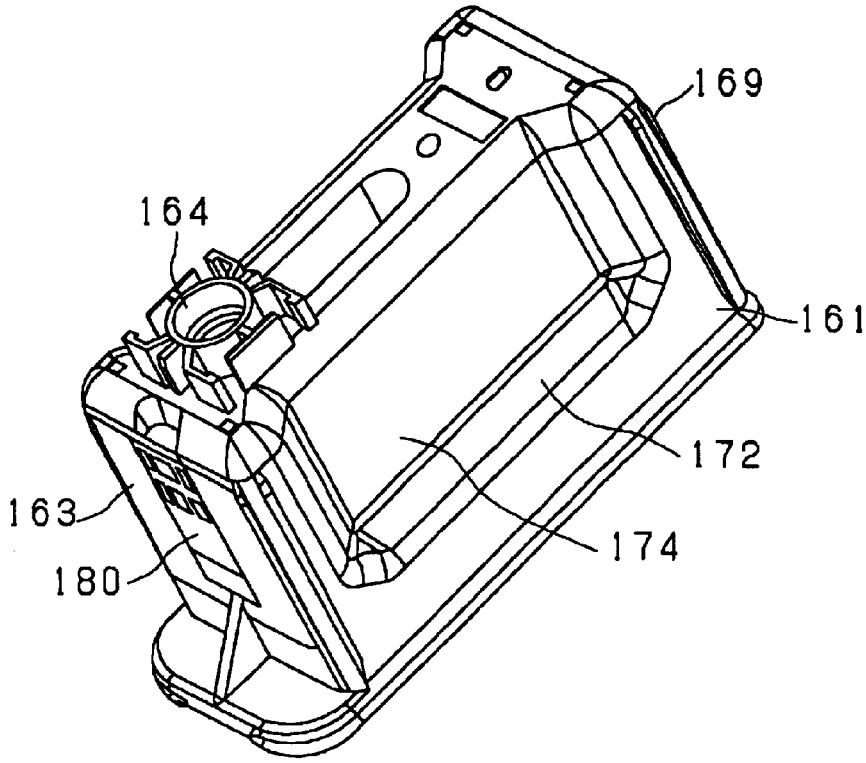
Figure 31A:
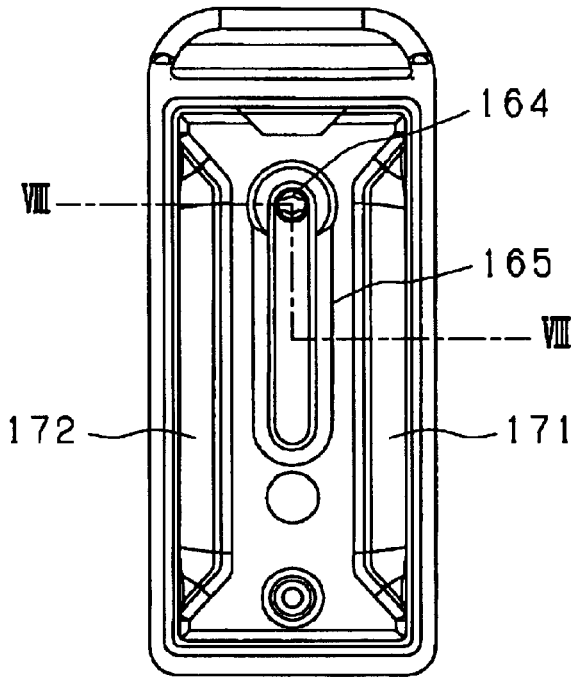
FIGS. 31(*a*) and (*b*) are the upper surface view showing the bottom structure of the ink cartridge with a lid member off, and a structural view in section taken along the line VIII—VIII, in FIG. 31(*a*).
Figure 31B:
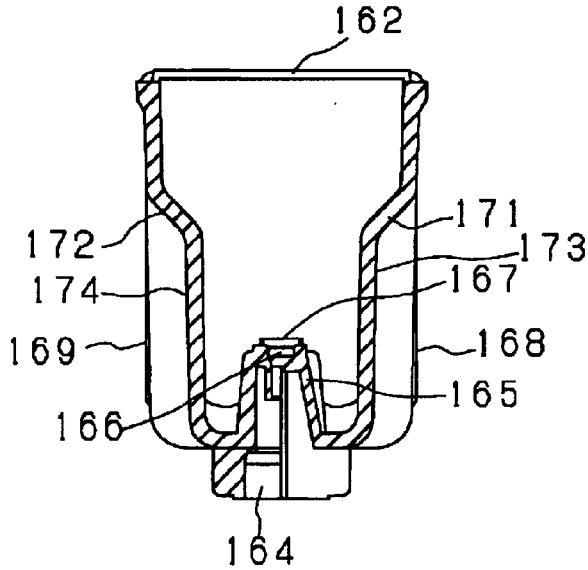
Figure 32:
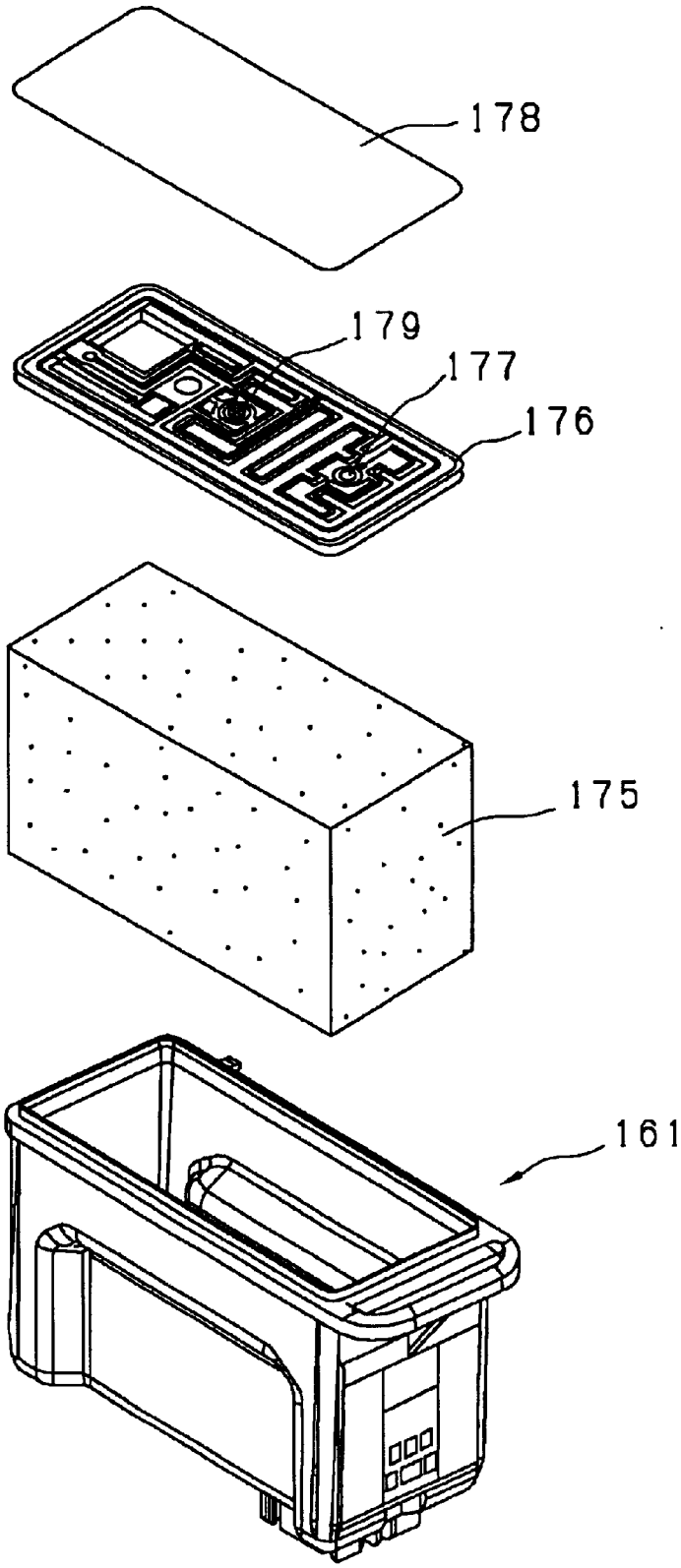
FIG. 32 in a perspective assembly view of the ink cartridge.

FIGS. 30(*a*) and (*b*) and 31(*a*) and (*b*) show the seventh embodiment of an ink cartridge of the present invention. FIG. 32 is an exploded view of the ink cartridge. A substantially rectangular parallelepiped container body 161 is provided with an opening 162 thereon. On the bottom surface of the container body, an ink supply port 164 is formed in the vicinity of a short side wall 163. (This specification includes a rectangular parallelepiped shape whose upper surface slightly opens.)

One edge of the ink supply port 164 protrudes from the bottom of the container body 161. and connects with a convex portion 165 extending to the central area of a long side wall. On the surface of the convex portion 165, the concave portion 166 is formed and a filter 167 is provided thereon.

A cross sectional shape from the opening 162 of the container body 161 to a predetermined height is substantially the same in horizontal direction. Below the predetermined height, the long side walls 168 and 169 protrude toward an ink chamber so as to narrow the width of the cross sectional shape in a horizontal direction. Since the long side walls protrude toward inside of the ink chamber, the formed concave portion is formed by side walls 173, 174 and slopes 171, 172.

In such a constructed container body, an rectangular parallelepiped ink absorbing member 175, namely a porous member such as urethane foam is inserted as shown in FIG. 32, and the ink absorbing member has slightly larger cross section than that of the opening 162.

Figure 33A:
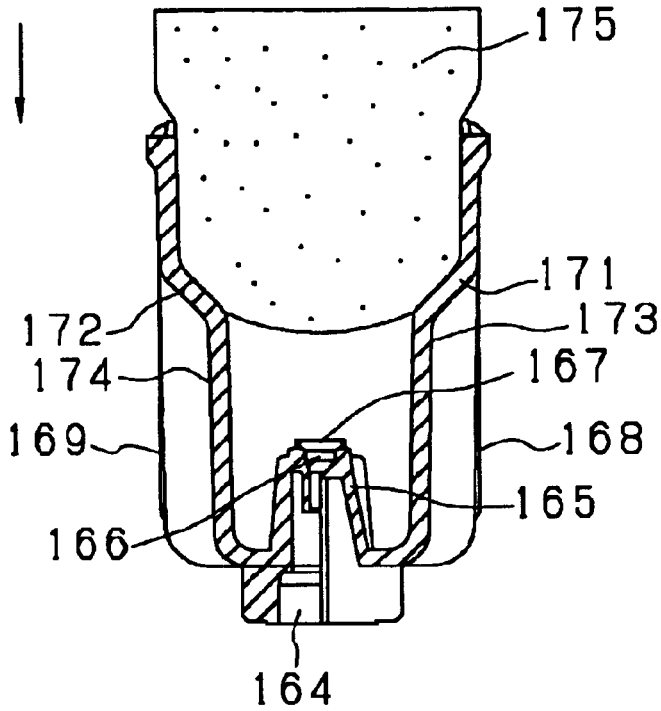
FIGS. 33(*a*) and (*b*) show a process for inserting an ink absorbing member into a container body so as to make an ink cartridge.
Figure 33B:
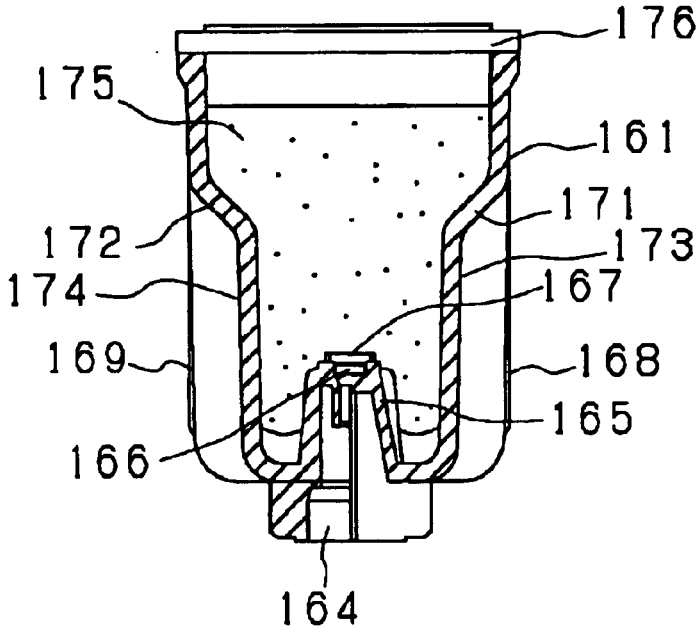

In the above-mentioned embodiment, below the opening 162, only the central area of the container body 161 composing an ink cartridge is formed to be narrowed. The opening 162 and upper part of both long sides walls are formed to be wide. Therefore, when the ink absorbing member 175 is inserted from the above, the central area of the ink absorbing member 175 is guided by the slopes 171 and 172 as shown in FIG. 33(*a*). Since the both long sides of the container body 161 are wide, the ink absorbing member having slightly large area is relatively easy to insert into the bottom without blocking.

Therefore, the ink absorbing member 175 moves until the edge surface is surely compressed by the filter 167, and corners of the container body 161 are filled with the ink absorbing member 175 as shown in FIG. 33(*b*).

After inserting the ink absorbing member 175 into the container body, the opening 162 is sealed with a lid member 176 (FIG. 32) so that an ink cartridge is made. The lid member 176 is welded to a container body 161 by ultrasonic vibration.

After making a sealed container body, a commonly known sealing film is attached to the ink supply port 164, and the container body is housed under reduced pressure. And, fully degassed ink in advance is injected from an ink injecting port 179. Finally, a film 178 is adhered to the surface of the lid member 176 so as to seal the ink injecting port 179 and an air communicating port 177, and the ink cartridge is completed.

When the ink cartridge is mounted on a holder of a carriage, a storage device 180 is provided at a portion contacting with a portion formed in a recording apparatus, or at one of the abort side walls close to the vicinity of the ink supply port 164 in this embodiment.

Figure 34A:
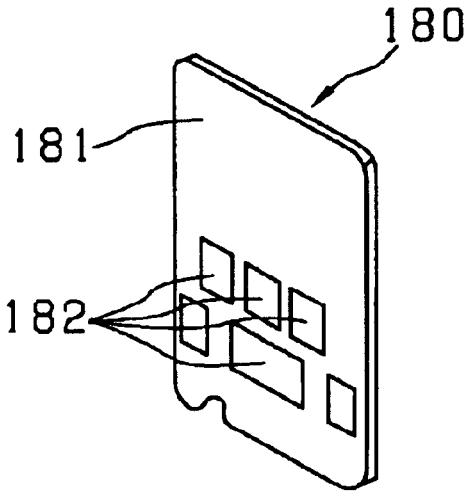
FIGS. 34 (*a*) and (*b*) show an embodiment of a storage device attached to the ink cartridge.
Figure 34B:
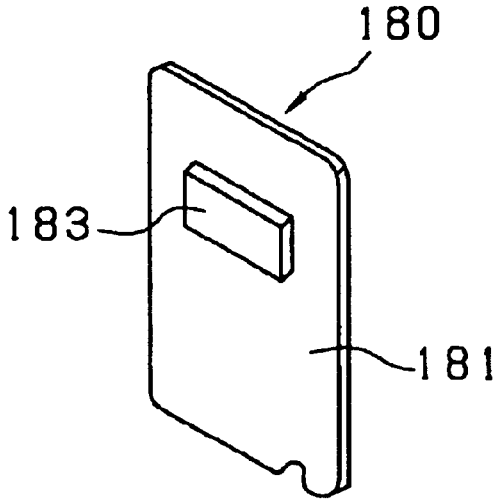

As shown in FIGS. 34(*a*) and (*b*), electrodes 182 contacting with electrodes formed in the recording apparatus are formed on the surface of a circuit board 181, and a semiconductor storage device 183 connecting with the electrodes 182 is provided on the back of the circuit board 181.

The storage device 180 stores information regarding a cartridge, such as manufacturing number, the date of manufacture, kinds of inks, ink volume, and so on. The information is readable from a recording apparatus via the electrodes 182. When a writable or rewritable element is applied to the semiconductor storage device 183, the amount of residual ink is written so as to control an ink end for certain.

In this ink cartridge, the width of the upper side area of the opening portion 162 is wide. And, the lower area of the container body narrows. Therefore, a lower part of the ink absorbing member 175 with rectangular parallelepiped is strongly compressed so as to have strong capillary force. Accordingly, when ink is consumed by printing, ink absorbed at the upper area of the ink absorbing member is assured to lead to the ink supply port 164 by the strong capillary force, and the ink is effectively used without running out.

Even if an ink cartridge with less ink volume is made so as to correspond to a high speed printing by decreasing the inertia of the carriage, a predetermined size of the upper area of the ink cartridge is formed so as to be easily gripped for mounting on the carriage.

As explained above, in the seventh embodiment, the bottom portion of a long side wall of a container body is narrowed by the long side wall protruding to the central area via a sloped portion. Therefore, the area which is easily gripped for attaching to or removing the ink absorbed member from a carriage is not unnecessarily too small, and just pressing the ink absorbing member into the container body reliably inserts the ink absorbing member thereon, and it is easily possible to produce an ink cartridge with a small volume.

What is claimed is:

1. An ink cartridge for use in an ink jet recording apparatus comprising:

a container body housing an ink absorbing member for absorbing ink in an ink chamber;

an ink supply port which communicates said ink chamber to a recording head;

a lid member sealing an opening portion of said container body; and a spacer inserted between said lid member and said ink absorbing member for pressing said ink absorbing member toward said ink supply port;

wherein an ink injecting port and an air communicating port are formed in said lid member, and through holes are formed in said spacer so as to be opposed at least to said ink injecting port.

2. An ink cartridge for use in an ink jet recording apparatus comprising:

a container body having an ink chamber and an opening portion wherein an ink absorbing member for absorbing ink is housed in said ink chamber;

an ink supply port which communicates said ink chamber to a recording head;

a lid member sealing said opening portion of said container body; and a spacer, which is disposed between said lid member and said ink absorbing member and is separate from said lid member, wherein said spacer has a base portion which faces said lid member, and a pressing portion for pressing said ink absorbing member toward said ink supply port, wherein a convex portion is formed at said ink supply port, said convex portion protrudes from a bottom of said container body and has an ink flow path communicating with said ink supply port, and said pressing portion comprises ribs which contact with said ink absorbing member at an area of said ink absorbing member which does not oppose said ink flow path.

3. An ink cartridge for use in an ink jet recording apparatus comprising:

a container body having an ink chamber and an opening portion wherein an ink absorbing member for absorbing ink is housed in said ink chamber;

an ink supply port which communicates said ink chamber to a recording head;

a lid member sealing said opening portion of said container body; and a spacer, which is disposed between said lid member and said ink absorbing member and is separate from said lid member, wherein said spacer has a base portion which faces said lid member, and a pressing portion for pressing said ink absorbing member toward said ink supply port, wherein said container body is divided into a plurality of ink chambers by walls, each of said plurality of ink chambers communicating with said ink supply port, and each of said plurality of ink chambers is provided with said ink absorbing member and said spacer.

4. An ink cartridge system, comprising:

a container body having an ink chamber;

an ink supply port which communicates said ink chamber to a recording head;

a first lid member adapted to seal an opening portion of said container body, wherein first ribs are formed in the back of the first lid member;

a first ink absorbing member adapted to absorb ink in said ink chamber when said first lid member seals said opening portion of said container body;

a second lid member adapted to seal said opening portion of said container body, wherein second ribs are formed in the back of the second lid member;

a second ink absorbing member adapted to absorb ink in said ink chamber when said second lid member seals said opening portion of said container body;

wherein, when said first lid member seals said opening portion of said container body, said first ribs oppose said ink supply port and press the first ink absorbing member toward said ink supply port, wherein, when said second lid member seals said opening portion of said container body, said second ribs oppose said ink supply port and press the second ink absorbing member toward said ink supply port, wherein a first rib height of said first ribs is different than a second rib height of said second ribs, and wherein a first member volume of said first ink absorbing member is different than a second member volume of said second ink absorbing member.

5. The ink cartridge system as claimed in claim 4, wherein said first rib height is smaller than said second rib height, and wherein said first member volume is greater than said second member volume.

6. The ink cartridge system as claimed in claim 5, wherein a first member height of said first ink absorbing member is greater than a second member height of said second ink absorbing member.

7. An ink cartridge for use in an ink jet recording apparatus, comprising:

a container body having a first side wall, a second side wall, a third side wall, and a bottom wall, wherein said container houses an ink absorbing member for absorbing ink in an ink chamber;

an ink supply port which communicates said ink chamber to a recording head, wherein said ink supply port is formed on the bottom wall and is positioned close to the first wall;

a concave portion formed at the second side wall so as to protrude to said ink chamber;

at least one rib formed at said concave portion so as to be parallel to the third side wall and to protrude to said ink supply port; and an ink absorbing member comprising an elastic ink absorbing member, wherein said ink absorbing member is supported by said first side wall and said rib, and has a length corresponding to said ink chamber regulated by said rib.

8. The ink cartridge for use in an ink jet recording apparatus according to claim 7, wherein said ink absorbing member is pressed by the lid member composing said container body at an ink discharge port communicating with said ink supply port.

9. The ink cartridge for use in an ink jet recording apparatus according to claim 7, wherein said container body is divided into a plurality of ink chambers by partition portions, and said concave portion is formed to straddle said partition portions.

10. The ink cartridge for use in an ink jet recording apparatus according to claim 7, wherein ribs protruding from the second side wall are formed on said ink chambers partitioned by partition walls of said container body.

11. The ink cartridge for use in an ink jet recording apparatus according to claim 7, wherein a protruded length of said ribs is adjusted according to the amount of ink to be stored.

12. The ink cartridge for use in an ink jet recording apparatus according to claim 7, wherein said concave portion functions to position said container body against a holder for holding the ink cartridge.

13. The ink cartridge for use in an ink jet recording apparatus according to claim 7, wherein a storage device storing information regarding ink stored amount is attached so as to be readable by a recording apparatus.

14. The ink jet cartridge for use in an ink jet recording apparatus according to claim 7, wherein a width of the ink chamber is narrower than a width of the second side wall of the ink chamber.

15. The ink jet cartridge for use in an ink jet recording apparatus according to claim 7, wherein a width measured in a direction parallel to the second side wall of the ink chamber is wide at an opening portion of the container body and narrow at an ink supply port side of the container body.

16. An ink cartridge for use in an ink jet recording apparatus comprising:

a container body having a first side wall and a bottom wall, wherein where the first side wall and the bottom wall join, a protruding portion is formed to protrude into said container body;

an ink absorbing member for absorbing ink is housed in an ink chamber;

an ink supply port which communicates said ink chamber to a recording head, wherein said ink supply port is formed on the bottom wall; and a lid member sealing an opening portion of said container body, wherein said container body has a second side wall which is shorter than said first side wall.

17. The ink cartridge for use in an ink jet recording apparatus according to claim 16, wherein a bottom portion of the side wall in said container body protrudes to the ink chamber.

18. The ink cartridge for use in an ink jet recording apparatus according to claim 16, wherein said protruded portion includes a sloping portion.

19. The ink cartridge for use in an ink jet recording apparatus according to claim 16, wherein said ink absorbing member is strongly compressed at a central area of a bottom portion of said ink chamber.

20. The ink cartridge for use in an ink jet recording apparatus according to claim 16, wherein a storage device storing information regarding an ink stored amount is attached so as to be readable by a recording apparatus.

21. An ink cartridge for use in an ink jet recording apparatus comprising:

a container body having a first side wall and a bottom wall, wherein where the first side wall and the bottom wall join, a protruding portion is formed to protrude into said container body;

an ink absorbing member for absorbing ink is housed in an ink chamber;

an ink supply port which communicates said ink chamber to a recording head, wherein said ink supply port is formed on the bottom wall; and a lid member sealing an opening portion of said container body, wherein said ink supply port communicates with a concave portion formed at a projection extending from a substantially central portion of the bottom wall.

22. An ink cartridge for use in an ink jet recording apparatus comprising:

a container body having an ink absorbing member for absorbing ink in an ink chamber;

an ink supply port which communicates said ink chamber to a recording head;

wherein an internal space of said container body is divided into a plurality of areas by walls, wherein at least one of said areas is a first area forming said ink chamber and storing ink, and at least one of said areas is a second area, which is not in communication with said first area and is isolated from the stored ink, wherein only said at least one of said areas forming said ink chamber and storing the ink is provided with said ink supply port and said ink absorbing member, and wherein a storage device storing information regarding an ink stored amount is attached to said ink cartridge so as to be readable by a recording apparatus.

23. An ink cartridge for use in an ink jet recording apparatus, comprising:

a container body installed in a holder of the ink jet recording apparatus having an ink absorbing member for absorbing ink in an ink chamber;

an ink supply port which communicates said ink chamber to a recording head, wherein said ink supply port is formed on a bottom wall of said container body;

a concave portion formed on a side wall of said container body and extending from the bottom wall of said container body, wherein said concave portion protrudes into said ink chamber; and a wall partitioning said ink chamber, wherein said wall is positioned inside of the side wall in contact with the holder, wherein a storage device storing information regarding an ink stored amount is attached so as to be readable by a recording apparatus.

24. A method for manufacturing an ink cartridge, comprising:

(a) providing a container body having an ink chamber, and opening portion, and an ink supply port, wherein said ink supply port communicates said ink chamber to a recording head;

(b) determining whether said ink cartridge will have a first ink capacity to accommodate a first volume of ink or will have a second ink capacity to accommodate a second volume of ink that is different than the first volume of ink;

(c) when said ink cartridge will have said first ink capacity, disposing a first ink absorbing member in said ink chamber, wherein said first ink absorbing member has a first member volume;

(d) when said ink cartridge will have said first ink capacity, sealing said opening portion of said container body with a first lid member, wherein first ribs are formed in the back of said first lid member, oppose said ink supply port, and press the first ink absorbing member toward said ink supply port and wherein said first ribs have a first rib height;

(e) when said ink cartridge will have said second ink capacity, disposing a second ink absorbing member in said ink chamber, wherein said second ink absorbing member has a second member volume that is different than said first member volume;

(f) when said ink cartridge will have said second ink capacity, sealing said opening portion of said container body with a second lid member, wherein second ribs are formed in the back of said second lid member, oppose said ink supply port, and press the second ink absorbing member toward said ink supply port, and wherein said second ribs have a second rib height that is different than said first rib height.

25. The method as claimed in claim 24, wherein said first rib height is smaller than said second rib height, and wherein said first member volume is greater than said second member volume.

26. The method as claimed in claim 25, wherein a first member height of said first ink absorbing member is greater than a second member height of said second ink absorbing member.

27. An ink cartridge for use in an ink jet recording apparatus comprising:

a container body having an ink chamber;

an ink supply port which communicates said ink chamber to a recording head;

the internal space of said container body divided into a plurality of areas by walls; and a storage device storing information regarding an ink stored amount is attached to said ink cartridge so as to be readable by a recording apparatus, wherein at least one of said areas is a first area forming said ink chamber and storing ink, and at least another one of said areas is a second area, which does not communicate with said first area and does not store the ink, and wherein only said at least one of said areas forming said ink chamber and storing the ink is provided with said ink supply port.

28. An ink cartridge for use in an ink jet recording apparatus comprising:

a container body installed in a holder of the ink jet recording apparatus having an ink chamber;

an ink supply port which communicates said ink chamber to a recording head;

a concave portion formed on a side wall of said container body and extending from the bottom wall of said container body, wherein said concave portion protrudes into said ink chamber; and a wall partitioning said ink chamber positioned inside a side portion in contact with said holder;

wherein a storage device storing information regarding an ink stored amount is attached so as to be readable by a recording apparatus.

* * * * *